US011485533B1

(12) United States Patent
Hoffman et al.

(10) Patent No.: US 11,485,533 B1
(45) Date of Patent: Nov. 1, 2022

(54) VACUUM-ASSISTED ITEM BUNDLING SYSTEM

(71) Applicant: Amazon Technologies, Inc., Seattle, WA (US)

(72) Inventors: Brian Stuart Hoffman, Seattle, WA (US); Eric K. Wyman, Austin, TX (US); Paul Roy Raines, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/880,098

(22) Filed: May 21, 2020

(51) Int. Cl.

| | |
|---|---|
| ***B65B 47/10*** | (2006.01) |
| ***B65B 31/02*** | (2006.01) |
| ***B65B 7/28*** | (2006.01) |
| ***B65B 41/10*** | (2006.01) |

(52) U.S. Cl.
CPC ..... *B65B 47/10* (2013.01); *B65B 7/28* (2013.01); *B65B 31/02* (2013.01); *B65B 41/10* (2013.01)

(58) Field of Classification Search
CPC ..... B65B 47/10; B65B 31/02; B65B 31/024; B65B 41/10; B65B 41/12; B65B 11/50; B65B 11/52; B65B 53/00; B65B 5/08; B65B 2210/04; B65B 59/001
USPC ..... 53/427, 509, 574, 578, 453, 559
See application file for complete search history.

(56) References Cited

U.S. PATENT DOCUMENTS

| | | | | | |
|---|---|---|---|---|---|
| 2,331,762 | A * | 10/1943 | Brown | B65B 11/54 | 53/442 |
| 2,622,380 | A * | 12/1952 | Snyder | B65B 11/54 | 53/464 |
| 2,888,787 | A * | 6/1959 | Cloud | B29C 51/225 | 53/433 |
| 3,381,445 | A * | 5/1968 | Vogt | B29C 51/10 | 53/140 |
| 3,792,181 | A * | 2/1974 | Mahaffy | B65D 75/32 | 426/123 |
| 3,950,919 | A * | 4/1976 | Perdue | B65B 11/52 | 53/433 |
| 4,563,861 | A * | 1/1986 | Barillec | B65B 11/50 | 53/453 |
| 6,321,513 | B1 * | 11/2001 | Meixner | B65B 47/10 | 53/441 |
| 7,237,371 | B2 * | 7/2007 | Yamamoto | B32B 27/34 | 53/433 |
| 10,273,028 | B1 * | 4/2019 | Epstein | B65B 41/12 | |
| 10,669,054 | B1 * | 6/2020 | Hoffman | B65B 59/003 | |
| 2003/0075051 | A1 * | 4/2003 | Watanabe | B65B 5/105 | 99/468 |
| 2004/0128951 | A1 * | 7/2004 | Weder | B65B 43/50 | 53/435 |
| 2010/0101191 | A1 * | 4/2010 | Lindee | B65B 35/04 | 53/391 |

(Continued)

*Primary Examiner* — Joshua G Kotis
(74) *Attorney, Agent, or Firm* — Lee & Hayes, P.C.

(57) ABSTRACT

A system and method that causes at least one item to be placed within a portion of an elastic film positioned across a top surface of a container, the portion including a center portion in which the at least one item is placed. Air may be extracted from the container to create a vacuum within the cavity and to expand the center portion to create a void in the center portion within the cavity. Air may flow into the container to release the vacuum and contract the center portion of the elastic film as the void is decreased and eliminated.

19 Claims, 9 Drawing Sheets

(56) References Cited

U.S. PATENT DOCUMENTS

| | | | | |
|---|---|---|---|---|
| 2011/0027438 | A1* | 2/2011 | Finkowski | B65B 5/02 426/413 |
| 2014/0199150 | A1* | 7/2014 | Razumov | B65G 1/1378 414/800 |
| 2015/0020664 | A1* | 1/2015 | Skyum | B07C 5/38 83/401 |
| 2016/0251101 | A1* | 9/2016 | Kong | B65B 57/10 53/445 |
| 2018/0222619 | A1* | 8/2018 | Ehrmann | B65B 57/00 |
| 2019/0202069 | A1* | 7/2019 | Bando | B65G 47/082 |
| 2020/0078935 | A1* | 3/2020 | Kimura | B25J 9/1687 |
| 2020/0094997 | A1* | 3/2020 | Menon | B65B 57/14 |
| 2020/0324925 | A1* | 10/2020 | Hisawi | B65B 11/54 |
| 2022/0033123 | A1* | 2/2022 | Zheng | B65B 55/20 |

* cited by examiner

VACUUM-ASSISTED ITEM BUNDLING SYSTEM

BACKGROUND

The development of e-commerce has brought about an increase in order fulfillment, shipping, and distribution. To handle this increase, carriers or retailers often employ systems of packaging mechanisms to package items for transport and delivery. The items are delivered to the packaging mechanisms, which are utilized to package the items into packages. The packages are then transported via bins, chutes, and/or conveyor belts to delivery vehicles, which transport the bins and/or packages to deliver the packages based on their shipment addresses. However, oftentimes the packages that are shipped are not efficiently packed with the items for transport, and/or packages are not efficiently placed within the bins for shipment.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items. The systems depicted in the accompanying figures are not to scale and components within the figures may be depicted not to scale with each other.

DETAILED DESCRIPTION

Figure 1:
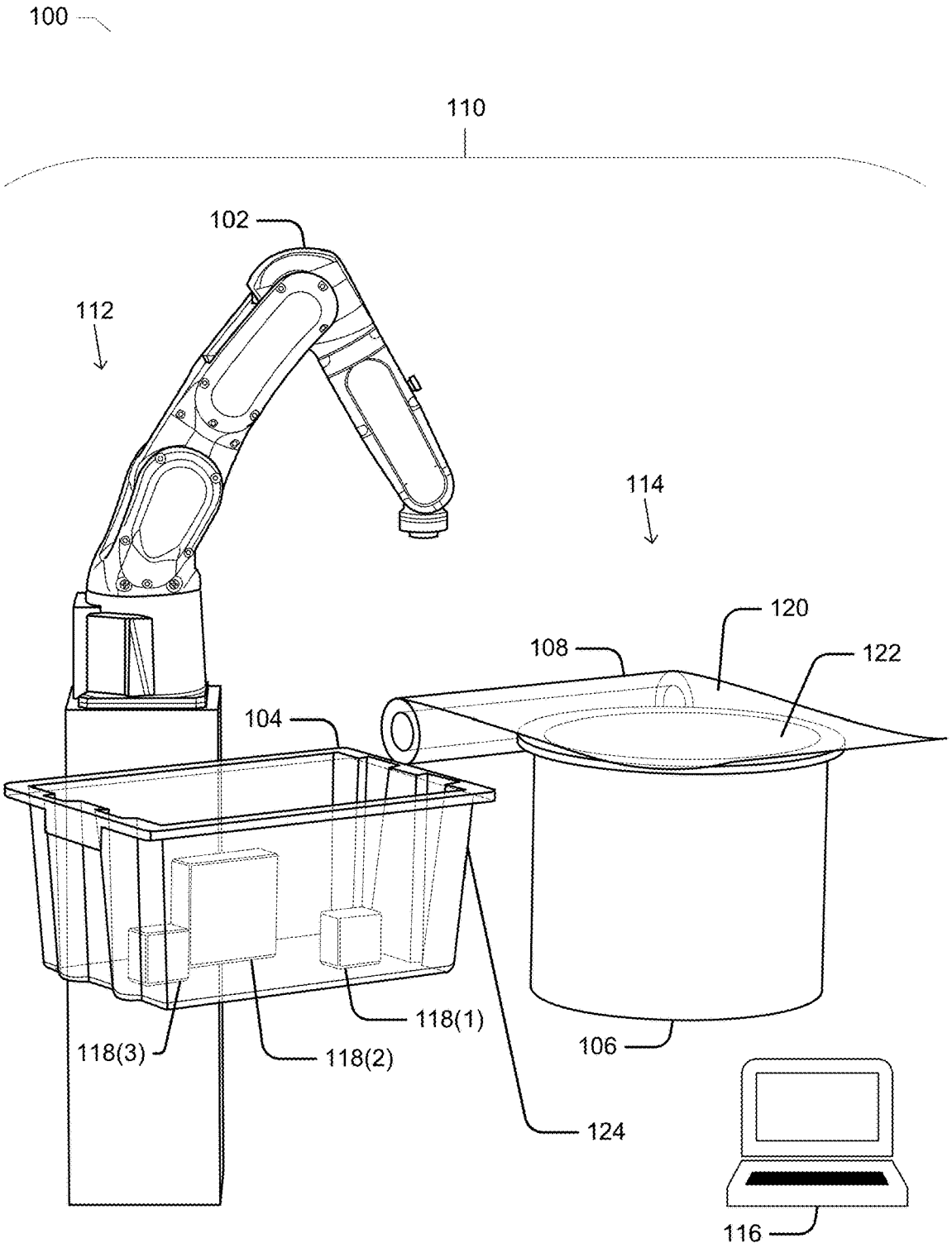
FIG. 1 illustrates an example workspace for receiving items and providing an elastic film from a spool of elastic film, according to an embodiment of the present disclosure.

Packaging techniques that are utilized for multiple items can be difficult from an automation point of view. For example, maneuvering multiple items toward and within a packaging mechanism can be complex and error prone. As multiple items are prepared to be packaged, positioning and maintaining control over the items can be cumbersome and inefficient. Attach points for the items change as the items being moved as a group or repositioned with respect to one another can shift. Loose items can fall or become separated from other items. Estimation of a size of package and/or envelope suitable for the multiple items can be difficult to predict and optimize, and therefore inconsistent. A volume of a package utilized for items packaged together for delivery can be difficult to minimize.

Discussed herein are systems and methods for packaging items within a workspace. In some embodiments, the systems and methods may be implemented or find use in a system (e.g., fulfillment system) for coordinating movements of components within a workspace. In some embodiments, the workspace may include one or more packaging stations. The packaging stations may include one or more robotic mechanisms, one or more package preparation mechanisms, and/or one or more sealing mechanisms to retrieve items from bins, package the items, and/or transport packages including the items for delivery. During this process, the robotic mechanisms may retrieve and scan items that are unsorted or sorted. The robotic mechanisms may transport the items to the package preparation mechanisms utilized to package the items into sealed packages. The package preparation mechanisms may include containers utilized to seal the items into sealed packages. The sealing mechanisms may include any mechanisms suitable for sealing the packages as sealed (e.g., air tight, weatherproof, waterproof, etc.) packages. The sealing mechanisms may include, but are not limited to, twist ties, covers, etc. The robotic mechanisms may transport the sealed packages via conveyer belts and/or chutes to packaging mechanisms that package the sealed packages in corrugated packages. The sealed packages and/or corrugated packages may be transported via bins, conveyor belts, or chutes to delivery vehicles (e.g., trucks, aerial vehicles, etc.).

In some embodiments, the workspace may include a packaging station with a robotic mechanism (e.g., robotic arm) adjacent to an intake area and a package preparation area. The intake area may include one or more item retrieval mechanism(s). The one or more item retrieval mechanism(s) may be any type of mechanism(s) suitable for storing and/or transporting one or more items. For example, each of the item retrieval mechanism(s) may be, but is not limited to being, a tote, a bin, a box, a bag, a container, a cart, a table, etc. The package preparation area may include one or more package preparation mechanism(s). For example, each of the package preparation mechanism(s) may be, but is not limited to being, a container with any type(s) of one or more characteristic(s) (e.g., size, shape, material, etc.) suitable for sealing items of various weights and sizes. For example, a shape of the container may be, but is not limited to, cylindrical, cubic, etc. A shape of a base of the container may be, but is not limited to, a circle, a square, a rectangle, etc. A material of the container may be any solid or durable material including, but not limited to, plastic, metal, rubber, etc. The container may include a top surface that includes an opening. The top surface of the container may be ring-shaped and may include a lip that is positioned at a perimeter or circumference of the top surface of the container to surround the opening of the top surface of the container. The cylindrical shape of the container may have improved consistency and reliability for sealing items within the container based on uniformity of distances between any position of an interior surface of the side surface of the container to an opposite position on the interior surface of the side surface, with respect to a center of the container.

In some embodiments, the tote may have any type(s) of one or more characteristic(s) (e.g., size, shape, material) suitable for holding items of various weights and sizes. The one or more characteristic(s) (e.g., size, shape, material, etc.) of the tote may be, respectively, the same as, or different from, the one or more characteristic(s) of the container. A material of the tote may be any material suitable for receiving the items. For example, the material of the tote may include, but is not limited to, a solid, durable, and/or rigid material including plastic, metal, rubber, etc., or a soft, pliable, non-rigid material including canvas, plastic, rubber, etc. For example, the tote may be a bin with at least one ridge and/or concave portion at a side surface, which may be utilized to lift, carry, and/or move the tote. The bin may have a shape that allows the tote to be stacked with other totes and/or placed and secured on a cart. The material of the tote, which is utilized for receiving and transporting items within the workspace, may be less rigid or durable than, the material of the container, which is utilized for sealing items.

The package preparation mechanism may include one or more air flow control mechanism(s) (e.g., valve) located at the container. The valve may be located at a surface (e.g., bottom surface, side surface, etc.) of the container. By way of example, the valve may be located at the bottom surface of the container, and near a corner or edge between the bottom surface and the side surface of the container. The valve may include an end in an interior area (e.g., cavity) of the container and an end that is in an area that is external to (e.g., outside) the container. The valve may have any shape suitable for providing air flow into, or extracting air out of, the container. For example, the valve may have, but is not limited to, a shape that is L-shaped, straight, curved, etc. The valve may be of any type suitable for automatic and/or manual control of air flow into or out of the container. For example, the valve may be, but is not limited to, a pneumatic solenoid valve. The valve may be coupled to an air flow routing mechanism (e.g., hose, tube, pipe, etc.), which may be coupled to an air pump. In some examples, the valve may be coupled directly to the air pump. The air pump may be controlled to extract air from the container and/or pump air into the container.

In some embodiments, the container may include an upper surface and an opening in the upper surface. The container may be positioned adjacent to one or more spools of a membrane. The membrane may be any type of membrane with a material suitable for being expanded and extended downward into the container at a first time, and subsequently being contracted (and retracting upward) in the container at a second time, to seal items positioned in the membrane as a sealed package. For example, the membrane may be, but is not limited to being, an elastic film, a plastic film, or any other material that is capable of enveloping (e.g., enclosing) the items. Each of the spools of elastic film may be automatically or manually operated to position a portion of membrane (herein referred to as "elastic film"). By way of example, the portion of elastic film may include a portion of an elastic film that is positioned above the container (e.g., above the upper surface and the opening in the upper surface of the package preparation mechanism). By way of example, a spool of elastic film may be controlled to rotate to dispense the elastic film to position the portion of elastic film above the container. Although one spool may be utilized to dispense the elastic film, a number of spools that dispense and/or retrieve elastic film is not limited to one.

In some embodiments, a clamp may be positioned above the portion of elastic film, which is positioned above the container. The clamp may be positioned on an opposite side of the portion of elastic film with respect to the container to restrain movement of the portion of elastic film. The clamp may be made of any type of material suitable for preventing movement of the portion of elastic film. In some examples, the material of the clamp may be a solid, durable, and/or rigid (e.g., non-pliable) material including, but not limited to metal, plastic, rubber, etc. The clamp may have any shape suitable to prevent movement of the portion of elastic film. For example, that clamp may have a shape that conforms to the shape of the lip of the container including, but not limited to, a ring shape (e.g., corresponding to the lip being ring shaped), a square shape (e.g., corresponding to the lip having a square shape), etc.

In some embodiments, a clamp positioning mechanism (e.g., clamp control mechanism) may be utilized to position the clamp on the container. The clamp positioning mechanism may apply pressure (e.g., press down) on the clamp in a direction of the portion of elastic film, to restrain movement of the portion of elastic film. The clamp positioning mechanism may be of any type suitable to maneuver the clamp and apply pressure to restrain movement of the portion of elastic film may be utilized to control the clamp. For example, the clamp positioning mechanism may be, but is not limited to, a vise grip (e.g., horseshoe vise grip, U-shaped vise grip, etc.), suction grip, etc., which may be detachably coupled to the robotic arm or fixedly coupled to another robotic arm. The clamp positioning mechanism may be automatically and/or manually controllable to grip or adhere to the clamp. By way of example, the clamp positioning mechanism may be a vise grip with arms that each have an inside surface that may be positioned adjacent to (e.g., against) an exterior side surface of the clamp, to press inward and grasp the clamp. Each of the arms of the vise grip may include a bottom surface that covers a portion of a top surface the clamp, to press down on the clamp. By way of example, the clamp positioning mechanism may be controlled to close the arms together to clasp the clamp, maneuver the clamp to the position above the portion of elastic film. The arms of the clamp positioning mechanism may apply a downward force on the clamp and the elastic film, the force being applied in a direction (e.g., downward direction) of the container.

In some embodiments, a cover may be positioned in the opening of the top surface of the container. The cover may include a side surface with an outer (e.g., exterior) surface that is positioned against an interior surface of the side surface of the container. The cover may include a center surface with an upper surface to which a shipping label is applied. The cover may have any types of one or more characteristics (e.g., size, shape, material, etc.) suitable for being adhered to the portion of elastic film for sealing the items of various sizes and weights. For example, a shape of the cover may be, but is not limited to, cylindrical, cubic, etc., to correspond (e.g., conform) to the shape of the container. In some examples, a material of the cover may be any material suitable for providing an air tight seal (or close to air tight seal) between the cover and the elastic film. For example, the material may be a moldable and/or pliable material including, but not limited to, paper, plastic, rubber, etc. In other examples, the material of the cover may be a solid, durable, and/or rigid (e.g., non-pliable) material including, but not limited to, plastic, metal, rubber, etc. In some examples, the material of the cover may be a material that is the same as, or different from, the material of the container. The material of the cover may be the same as the material of the elastic film to improve a strength of adherence between the cover and the elastic film. The material of the cover and/or the material of the elastic film may include barriers and/or reinforcements to reduce a likelihood of catastrophic damage to the sealed package with the items if the sealed package is caused to be damaged (e.g., ripped, dented, deformed etc.).

In some embodiments, a robotic mechanism (e.g., cover control mechanism) may be utilized to transport the cover to a position near (e.g., above) the container and lower the cover into the opening. The cover control mechanism may be of any type suitable for maneuvering the cover. For example, the cover control mechanism may be, but is not limited to being, controlled by the robotic arm that is used to maneuver the items into the container, another/different robotic arm, an individual, etc. The cover control mechanism may be a robotic gripping component (e.g., claw, vise grip, suction cup, etc.) detachably or permanently coupled to the robotic arm.

In some embodiments, the packaging station may include data collection mechanisms. The data collection mechanisms may include any mechanism (e.g., sensor or scanner) suitable for sensing characteristics (e.g., locations, sizes, weights, etc.) of objects near and within the packaging station. For example, the data collection mechanisms may include, but are not limited to, a weight sensor, a digital label scanner, a bar code scanner, a QR code scanner, a RFID scanner, a laser sensor, an infrared sensor, a radar sensor, etc. The data collection mechanisms may be controllable by any mechanism suitable for moving and/or activating the data collection mechanisms to gather data based on the one or more items received by the packaging station. For example, the data collection mechanisms may be controllable by mechanisms including, but not limited to, the robotic arm of the packaging station, another robotic arm in or near the packaging station, another mechanism automatically controllable by the packaging station computing device, or another mechanism automatically and/or manually controllable by the operator of the packaging station.

In operation, one or more computing devices (e.g., packaging station computing device, operator computing device, etc.) may control operations of one or more packaging stations. The one or more computing devices may be configured to communicate with a centralized control system to receive task assignments and/or transmit requests to control a packaging station to move, package, and seal items as a sealed package. Each of the one or more computing devices may be configured to transmit any suitable data indicating operation of the packaging station to the centralized control system. Although, for purposes of simplicity, the description below refers to various functions of the packaging station computing device, any computing device and/or system suitable for controlling the operation of the computing device may be used for performing the functions. For example, the packaging station computing device, the operator computing device, or the centralized control system may, independently or interactively with an operator and/or any other of the devices and/or system, perform some or all of the functions to operate the packaging station.

In some embodiments, the packaging station computing device may receive a signal indicating that a tote has been received by the packaging station. In some examples, the signal may be received from the one or more data collection mechanisms indicating that the tote has been received. In other examples, the signal may be received based on input received from the operator of the packaging station, via an input/output (I/O) interface of the packaging station computing device. In other examples, the packaging station computing device may control the robotic arm to be detachably coupled to the tote and/or to raise the tote off of a surface on which the tote is positioned, based on determining that the tote has been received in an area near the packaging station, and control the robotic arm to move the tote to the intake area.

In some embodiments, the packaging station computing device may receive a signal from the one or more data collection mechanisms including information about one or more items positioned in the tote. The one or more items can be received in an unsorted order or a sorted order. The one or more items can include a first item, a second item, and a third item. By way of example, the first item, the second item, and the third item can be received in the tote in the sorted order based on distances from the first item, the second item, and the third item to a side surface of the tote (e.g., side surface that is closest to the packaging area). A distance between the first item and the side surface can be less than a distance between the second item and the side surface, and less than a distance between the third item and the side surface, to indicate that the first item is to be moved out of the tote before the second item and the third item. The distance from the second item to the side surface can be less than the distance from the third item to the side surface, to indicate that the second item is to be moved out of the tote before the third item.

In some embodiments, the packaging station computing device may determine a package preparation mechanism of the packaging station is ready to receive a portion of elastic film to be positioned above the container. A determination that the packaging station is ready to receive the portion of elastic film may be based on, for example, at least one of the items being sensed or an input being received from the operator, via the I/O interface. The packaging station computing device may perform an operation including, but not limited to, at least one of controlling a spool of elastic film to rotate, outputting an indicator that the packaging station is ready for the spool of elastic film to be rotated to position the portion of elastic film, or temporarily ceasing subsequent operations until a determination is made that the portion of elastic film is positioned above the container. By way of example, the determination to resume may be based on, but is not limited to, at least one of a sensor signal (e.g., signal from one of the data collection mechanisms) indicating that an amount of rotation of the spool has exceeded a predetermined amount, a sensor signal (e.g., signal from one of the data collection mechanisms) indicating the portion of elastic film is positioned above the container, or a signal based on input from the operator is received, via the I/O interface. The spool may be controlled to rotate automatically by the robotic arm and/or an automated rotation mechanism of the spool (e.g., motor of the spool that is controlled to rotate) or may be manually controlled by the operator to rotate.

In some embodiments, a spool of elastic film may be controlled to rotate to dispense the elastic film and position the portion of elastic film above the container. By way of example, the spool may be controlled to rotate to position the portion of elastic film, based on the one or more items being received and/or scanned. The portion of elastic film may be positioned above the container based on the elastic film being automatically manipulated by the robotic arm or manually manipulated by the operator. By way of example, a spool of elastic film that is opposite the spool dispensing the elastic film may be controlled to rotate to retrieve the elastic film, as the portion of elastic film is being positioned above the container. The spool that dispenses the elastic film may include an undispensed (e.g., new/unused) portion of elastic film. The spool that retrieves the elastic film may include a dispensed (e.g., spent/used) portion of elastic film.

In some embodiments, the portion of elastic film may be positioned above the container, prior to the one or more items being received and/or scanned. The packaging station computing device may determine that the intake area of the packaging station is ready to receive items based on, but not limited to, at least one of a signal indicating that an amount of rotation of the spool has exceeded a predetermined amount, a signal received from at least one of the one or more data collection mechanisms indicating the portion of elastic film is positioned above the container, or an input received from the operator, via the I/O interface. Based on a determination that the container of the packaging station is ready to receive items, the packaging station computing device may perform at least one operation including, but not limited to, outputting an indication to the operator via the I/O interface, temporally ceasing subsequent operations until the one or more items are received at the intake area and scanned, or transmitting a signal to the centralized control system to indicate the packaging station is ready to receive and scan items. If a signal is received from at least one of the one or more data collection mechanisms based on the one or more items being detected as having been received in the intake area, the packaging station computing device may perform operations including scanning the one or more items and determining that the one or more items are ready to be transported from the tote in the intake area to the container in the package preparation area.

In a scenario in which the portion of elastic film is determined to be positioned above the container, the packaging station computing device may determine that the portion of elastic film is ready to receive the clamp. In some examples, the packaging station computing device may determine that the portion of elastic film is ready to receive the clamp based on the elastic film being determined to be positioned above the container and the items being determined to be positioned in the intake area. The packaging station computing device may control the robotic arm or another robotic arm to position the clamp above the container and apply a force to the clamp in a downward direction toward the container. A position of the clamp may be fixed based on the force applied to the clamp, to prevent motion of the portion of elastic film. The clamp may be controlled to remain motionless (e.g., continuously apply force in a downward direction) by any mechanism suitable to control the clamp to prevent movement of the portion of elastic film. For example, the clamp may be controlled by a mechanism including, but not limited to, the robotic arm, another robotic arm positioned in, or near, the packaging station, and/or another mechanism manually or automatically controlled by the operator of the packaging station.

In a scenario in which the items are determined to be positioned in the intake area, the packaging station computing device may determine to scan the items. The packaging station computing device may control one of the data collection mechanisms to scan the items to determine identification information and/or characteristic(s) of the items. In some examples, the one of the data collection mechanisms may scan the items to identify data based on one or more data provision mechanisms associated with one or more of the items. Each of the data provision mechanisms include any mechanism suitable for storing, supplying, and/or providing data (e.g., encoded data or unencoded data). For example, the data provision mechanisms may include, but are not limited to a label, a bar code, a quick response (QR) code, a radio frequency identification (RFID) code, etc. The data of each of one or more of the items may include identification information including, for example, at least one of a serial number, a product number, a model number, a brand name, a model name, etc. The characteristic(s) of one or more of the items may include, for example, at least one of a weight, a size, a material, etc. By way of example, the packaging station computing device may determine that items are in a sorted order or unsorted order based on one or more inputs associated with the items being received. The one or more inputs may include, for example, at least one of a signal received from another computing device that is associated with delivering the items to the packaging station, a signal received by the I/O interface based on input from the operator, a signal received from the centralized control system, etc. If the items are determined to be in the sorted order, the packaging station computing device may determine that identification information and/or characteristics of the items is known and that the items do not need to be scanned. If the items are received in the sorted order, the packaging station computing device may determine to scan the items based on determining that identification information and/or characteristics of the items is not known. The packaging station computing device may scan items that are received in the sorted order and determine that the items are ready to be transported to the container further based on the identification information and/or the characteristics of the items. If the items are in the unsorted order, the packaging station computing device may determine to scan the items based on the items being in the unsorted order. The packaging station computing device may scan the items in the unsorted order and determine the items are ready to be transported to the container further based on the identification information and/or the characteristics of the items.

In a scenario in which the position of the clamp on the portion of elastic film is fixed above the container, the packaging station computing device may determine that a center portion of the portion of elastic film above the container is ready to be expanded in the cavity of the container. The packaging station computing device may control the valve to be opened (e.g., activated) to allow air to be extracted from the cavity of the container and to create a vacuum within the interior of the container. The air may be extracted from the cavity to allow a center portion of the portion of elastic film positioned above the container to expand and extend downward into the cavity of the container. That is, the vacuum caused by the valve causes the elastic film that is extended over the opening of the container to be pulled or sucked into the interior of the container. The center portion may be allowed to expand and partially fill to conform to a portion of the cavity of the container. The center portion may be allowed to expand to less than all of the cavity and preserve an area of the cavity. In some examples, the packaging station computing device may provide, based on a determination that the portion of elastic film being ready to be expanded in the cavity of the container, an indication to the operator via the I/O interface to activate the valve. In some examples, the packaging station computing device may temporarily cease subsequent operations, based on the determination that the portion of elastic film being ready to be expanded in the cavity of the container, until an input is received from the operator via the I/O interface to indicate that the valve has been opened (e.g., activated) to extract the air. The packaging station computing device may control the valve to be closed (e.g., deactivated) as the center portion of the elastic film expands. The valve may be controlled to be closed (e.g., deactivated) based on an area of the cavity decreasing to less than a threshold area. The area of the cavity may be maintained to be greater than the threshold area to allow the vacuum in the cavity to be maintained and prevent the center portion of the elastic film from contacting the valve. The area of the cavity may be maintained to be greater than the threshold area to prevent a distance between the center portion of the elastic film and the valve from decreasing below a threshold distance (e.g., 0.5 inches, 1 inch, etc.). The packaging station computing device may control the valve to be closed (e.g., deactivated) based on input from the operator via the I/O interface, a signal from a sensor in the cavity indicating that the distance between the center portion of the elastic film and the valve equals the threshold distance, or a signal from a timer that senses an amount of time that lapses at which the valve is activated exceeds a threshold time. In some embodiments, the valve may continue to extract air from the cavity of the container until a pressure within the cavity reaches a predetermined pressure value, and/or the valve may cause the pressure within the cavity of the container to be maintained for a predetermined amount of time.

In a scenario in which the center portion of the elastic film is determined as having been expanded in the cavity of the container, the packaging station computing device may determine the items are ready to be transported from the intake area to the package preparation area. If the items are in a sorted order, the packaging station computing device may control the robotic arm to transport the items to the container, based on a determination that the items have been received and are positioned in the tote. If the items are in an unsorted order, the packaging station computing device may control the robotic arm to transport the items to the container, based on a determination that the items have been received and positioned in the tote, and further based on the identification information and/or the characteristics of the items. In other examples, if the items are in a sorted order, the packaging station computing device may control the robotic arm to transport the items that are sorted further based on the identification information and/or the characteristics of the items. The robotic arm may include a robotic carrying mechanism (e.g., automated claw/hand, automated suction cup, lever conforming to a portion of an object to be moved, etc.) that is controlled to be detachably coupled with objects including items to be packaged, totes in which items are received, clamps that seal elastic films on containers in the package preparation area, vise grips that transport clamps, containers in which items are packaged, packages sealed in the container, etc.

In some embodiments, once the intended items have been placed within the container by the robotic arm, the packaging station computing device may determine the container is ready to be sealed by a sealing mechanism including a cover or a twist tie mechanism. By way of example, the packaging station computing device may operate in a cover sealing mode or a twist tie sealing mode. The packaging station computing device may operate in the cover sealing mode based on determining the container is ready to be sealed by the cover. The packaging station computing device may operate in the twist tie sealing mode, based on determining the container is ready to be sealed by the twist tie mechanism. The packaging station computing device may be set to operate in the cover sealing mode or the twist tie sealing mode, based on input from the operator via the I/O interface.

In a scenario in which the packaging station computing device is being operated in the cover sealing mode, the packaging station computing device may determine that the container is ready to be covered with a cover, based on determining that the items have been placed in the container. By way of example, the packaging station computing device may determine that the items have been placed in the container based on a signal received from at least one of the one or more data collection mechanisms. The signal may indicate that all of the items have been retrieved from the tote and placed in the container, a determination that all of the items scanned have been placed in the container, and/or based on input received from an operator via the I/O interface of the packaging station computing device. By way of example, the packaging station computing device may further determine that the container is ready to be covered with a cover based on one or more signals that are received from at least one of the one or more data collection mechanisms and that indicate one or more characteristics associated with the container do not exceed corresponding one or more threshold characteristics, and/or based on input received from an operator via the I/O interface. The one or more signals may indicate that a height corresponding to a highest portion of any of the items in the container. The packaging station computing device may determine the height does not exceed a threshold height. The packaging station computing device may, based on determining the items have been placed in the container, and/or further based on the signal indicating the one or more characteristics associated with the container do not exceed corresponding one or more threshold characteristics, temporarily cease operations to allow the operator to position the cover on the container, output an indication via the I/O interface instructing the operator to position the cover on the container, and/or control the robotic arm to be detachably coupled to the cover and to position the cover on the container. The cover may be sealed (e.g., partially sealed) to the center portion of elastic film by sealing a portion of an outer side surface of the cover (e.g., less than all of the side surface of the cover) to a portion of an inner side surface of the center portion of elastic film (e.g., less than all of the interior side surface of the center portion of elastic film).

In some embodiments, the packaging station computing device may determine the package preparation mechanism is ready to have the valve opened (e.g., activated) to release the vacuum from the cavity of the container, based on determining that the cover is positioned on the container, and/or determining that the portion of the outer side surface of the cover is adhered to the initial adhering portion elastic film. By way of example, the packaging station computing device may determine that the cover is positioned on the container, and/or partially adhered to the portion of the interior surface of the center portion of elastic film, based on the robotic arm being determined to have positioned the cover and/or input received from the operator via the I/O interface of the packaging station computing device. Based on determining the package preparation mechanism is ready to have the valve opened (e.g., activated), the packaging station computing device may temporarily cease operations to allow the operator to activate the valve, output an indication to the operator via the I/O interface instructing the operator to activate the valve, and/or control (e.g., automatically/electrically) the valve be opened (e.g., activated) to release the vacuum and eliminate the void in the center portion of elastic film. As a result of opening the valve, air enters the cavity of the container, the vacuum is released, and the elastic film that was extended down into the cavity of the container moves upwards to contract around the item(s).

Therefore, the empty space within the void and around the item(s) is eliminated as a result of opening the valve.

In some embodiments, the packaging station computing device may determine the cover is ready to be sealed (e.g., completely sealed) to the center portion of elastic film, based on determining that the vacuum has been full released. By way of example, the packaging station computing device may determine that one or more characteristics of the package preparation mechanism exceed corresponding one or more threshold characteristics, and/or an amount of time that has elapsed since the valve was actuated exceeds a threshold amount of time. The one or more characteristics of the package preparation mechanism may be determined as having exceeded the corresponding one or more threshold characteristics based on, but not limited to, a signal from a pressure sensor associated with the cavity indicating that a pressure of the cavity is lowered to exceed a threshold pressure, and/or a signal from at least one of the one or more data collection mechanisms indicating that height a lowest portion of an outside surface of the center portion of elastic film increases to exceed a threshold height. Based on determining the cover is ready to be completely sealed and/or the cover is ready to receive the label, the packaging station computing device may temporarily cease operations to allow the operator to completely seal the cover and/or position the label on the cover, output an indication to the operator via the I/O interface indicating the cover is ready to be completely sealed and/or cover is ready to receive the label, and/or control the robotic arm to completely seal the cover and/or position the label on the cover. By completely sealing the cover, the package is sealed as a sealed package for delivery.

In a scenario in which the packaging station computing device is being operated in the twist tie sealing mode, the packaging station computing device may determine the package is ready to be sealed with the twist tie instead of the cover. The packaging station computing device may determine the center portion of elastic film (e.g., the portion of elastic film that includes the items) is ready to be twisted (e.g., turned or rotate) based on determining that the items have been placed in the container. The packaging station computing device may determine that the items have been placed in the container in a similar way as for the cover sealing mode, described above. By way of example, the packaging station computing device may further determine that the center portion of elastic film is ready to be rotated (e.g., partially rotated) based on one or more signals that are received from at least one of the one or more data collection mechanisms and that indicate one or more characteristics associated with the container exceed corresponding one or more threshold characteristics, and/or based on input received from an operator via the I/O interface. The signal from the at least one of the one or more data collection mechanisms may indicate that a height corresponding to a highest portion of any of the items in the container. The packaging station computing device may determine the height exceeds a threshold height. The packaging station computing device, based on determining the items have been placed in the container, and/or further based on the one or more signals indicating the one or more characteristics associated with the container exceed corresponding one or more threshold characteristics, may temporarily cease operations to allow the operator to rotate the center portion of elastic film, output an indication via the I/O interface instructing the operator to rotate the center portion of elastic film, and/or control the robotic arm to grip and rotate the center portion of elastic film and to create a twisted portion of elastic film between the clamp and a portion of the center portion of elastic film that include the items. The robotic arm may utilize any arm extension mechanism suitable for gripping and rotating the center portion. For example, the robotic arm may be coupled to an arm extension mechanism including, but not limited to, a robotic claw, a robotic clamp, etc. The center portion of elastic film may be rotated to partially seal the portion of elastic film that includes the items, via the twisted portion.

In some embodiments, the packaging station computing device may determine the package preparation mechanism is ready to have the valve opened (e.g., activated) to release the vacuum from the cavity of the container, based on determining that the portion of elastic film that includes the items is partially sealed, via the twisted portion. The packaging station computing device may determine the portion of elastic film that includes the items is partially sealed based on input from the operator via the I/O interface, an amount of time that has passed since determining the package preparation mechanism is ready to have the valve opened (e.g., activated) and that exceeds a threshold amount of time, and/or based on an amount of rotation (e.g., a number of rotations) of the center portion of elastic film. By way of example, the packaging station computing device may determine an amount of rotation of the center portion of elastic film, based on an amount of rotation of the arm extension mechanism of the robotic arm. The packaging station computing device may determine that the portion of elastic film that includes the items is partially sealed, based on determining the amount of rotation of the center portion of elastic film exceeds a threshold amount of rotation. Based on determining the package preparation mechanism is ready to have the valve opened (e.g., activated), the packaging station computing device may temporarily cease operations to allow the operator to activate the valve, output an indication via the I/O interface instructing the operator to activate the valve, and/or control (e.g., automatically/electrically) the valve be opened (e.g., activated) to release the vacuum and eliminate the void in the center portion of elastic film.

In some embodiments, the packaging station computing device may determine that the portion of elastic film that includes the items is ready to be completely sealed by rotating (e.g., completely rotating) the portion of elastic film. The portion of elastic film may be sealed via the twisted portion, based on determining that the vacuum has been full released. The packaging station computing device may determine that that the vacuum has been fully released similar as for the cover sealing mode, described above. Based on determining the portion of elastic film that includes the items is ready to be completely sealed, the packaging station computing device may temporarily cease operations to allow the operator to rotate the portion of elastic film that includes the items, output an indication via the I/O interface instructing the operator to rotate the portion of elastic film that includes the items, and/or control the robotic arm to rotate the portion of elastic film that includes the items.

In some embodiments, the packaging station computing device may determine that that the portion of elastic film is ready to be rotated (e.g., completely rotated) and that the twisted portion is ready to be clasped, based on an amount of time since the operations ceased being determined to exceed a threshold amount of time, input from the operator via the I/O interface indicating that the portion of elastic film with the items has been rotated to completely seal the items, and/or determining an amount of rotation of the robotic arm exceeds a predetermined amount of rotation. Based on determining the twisted portion is ready to be clasped, the packaging station computing device may temporarily cease operations to allow the operator to position a clasp around the twisted portion, output an indication via the I/O interface instructing the operator to position the clasp around the twisted portion, and/or control the robotic arm to position the clasp around the twisted portion. By completely sealing the portion of the portion of elastic film that includes the items and positioning the clasp around the twisted portion, the package is sealed as the sealed package for delivery.

In some embodiments, the packaging station computing device may determine the sealed package is ready to be retrieved from the container, based on determining the package has been sealed as the sealed package. By way of example, the packaging station computing device may determine that the robotic arm has finished completely sealing the package and/or positioning the label, determine that input has been received from the operator via the I/O interface indicating that the sealed package is ready to be retrieved, and/or an amount of time that has elapsed since determining the cover is ready to be completely sealed and/or the cover is ready to receive the label exceeds a threshold amount of time. Based on determining the sealed package is ready to be retrieved from the container, the packaging station computing device may temporarily cease operations to allow the operator to retrieve the sealed package, output an indication to the operator via the I/O interface indicating that the sealed package is ready to be retrieved, and/or control the robotic arm to retrieve the sealed package from the container.

It should be appreciated that the techniques discussed above are applicable in contexts other than fulfillment situations including, but not limited to, sorting situations, crossdock situations, etc. Utilizing the techniques discussed herein, coordination with the fulfillment system is improved by ensuring that multiple items may be efficiently, securely, and conveniently packaged, sealed, and transported. Additionally or alternatively, by utilizing the packaging system, partial or full automation of retrieval, packaging, sealing, and delivery of the packages may be enabled and optimized. The packages may be sealed to prevent any of the items from becoming separated from the package, reduce dunnage (e.g., bubble wrap, plastic, paper, cardboard, etc.) required to reduce or prevent movement of the items, and/or provide protection for the items of the package from environmental influences (e.g., moisture). The sealed packages may have sizes that remain consistent throughout delivery and/or transportation. Attach points associated with the sealed packages may be easily and consistently identified and utilized during the delivery and/or transportation. A distance between items in each of the sealed packages may be minimized to minimize a total volume of each of the sealed packages. Any suitable combination of the above improvements can lead to a more efficient use and reliability of a workspace and/or increased throughput of the system as a whole.

FIG. 1 illustrates an example workspace 100 including a robotic mechanism 102 adjacent to an item retrieval mechanism 104, a package preparation mechanism 106, and a spool 108 of membrane (e.g., elastic film), according to an embodiment of the present disclosure. The workspace 100 may include one or more packaging stations, including a packaging station 110. The packaging station 110 may include an intake area 112 adjacent to a package preparation area 114. The intake area 112 may include one or more robotic mechanisms, including the robotic mechanism 102 (e.g., an example of one of robotic mechanisms 808 described below in connection with FIG. 8). The item retrieval mechanism 104, for example, may be, but is not limited to being, a tote, a bin, a box, a bag, a container, a cart, a table, etc. The intake area 112 may receive the item retrieval mechanism (hereinafter "tote") 104, which may include one or more items 118. The package preparation area 114 may include the package preparation mechanism 106 and the spool 108. The packaging station 110 may include a packaging station computing device 116 (an example of packaging station computing device 806 described below in connection with FIG. 8).

By way of example, the packaging station 110 may be used for retrieving the items 118, rotating the spool 108 to provide an elastic film 120, and positioning a portion of elastic film 122 (e.g., portion of elastic film 120 corresponding to both an upper surface of the package preparation mechanism 106 and an opening in the upper surface of the package preparation mechanism 106). The portion of elastic film 122 may be positioned above the package preparation mechanism 106. The portion of elastic film 122 may be positioned to cover the package preparation mechanism 106.

In operation, the packaging station computing device 116 may receive a signal indicating that the tote 104 has been received by the packaging station 110. In some examples, the signal may be received from one or more data collection mechanisms (e.g., a weight sensor, a digital label scanner, a bar code scanner, a QR code scanner, a RFID scanner, a laser sensor, an infrared sensor, a radar sensor, etc.) of the packaging station 110, indicating that the tote 104 has been received. In other examples, the signal may be received based on input received from an operator (e.g., human operator) of the packaging station 110, via an input/output (I/O) interface (an example of I/O interface 818(2) described below in connection with FIG. 8) of the packaging station computing device 116. In other examples, the tote 104 may be received by the packaging station 110, via the robotic mechanism 102 (herein referred to as "robotic arm"). The packaging station computing device 116 may control the robotic arm 102 to be detachably coupled to the tote 104 and/or to raise the tote 104 off of a surface on which the tote 104 is positioned prior to being moved to the packaging station 110, based on determining that the tote 104 has been received in an area near the packaging station 110. The packaging station computing device 116 may control the robotic arm 102 to move the tote 104 to the intake area 112.

In some embodiments, the one or more items 118 included on or within the tote 104 can be received by the packaging station 110 by any mechanism suitable for transporting the one or more items 118 to the packaging station 110. For example, the one or more items 118 can be, but are not limited to being, received by the packaging station 110 via a conveyor, a mobile drive unit with a movable mechanism (e.g., a conveyor top or a flip top), or a chute positioned to direct items to the packaging station 110 (e.g., into the package preparation mechanism 106).

In some embodiments, the one or more items 118 included on or within the tote 104 can be received in an unsorted order or a sorted order. The packaging station computing device 116 may receive a signal from the one or more data collection mechanisms including information about one or more items 118 positioned in or on the tote 104. The one or more items 118 can include a first item 118(1), a second item 118(2), and a third item 118(3) (or any number of items 118). By way of example, the first item 118(1), the second item 118(2), and the third item 118(3) can be received in the tote in the sorted order based on distances from the first item 118(1), the second item 118(2), and the third item 118(3) to a side surface 124 of the tote (e.g., side surface that is closest to the packaging area). A first distance between the first item 118(1) and the side surface 124 can be less than a second distance between the second item 118(2) and the side surface 124, and less than a third distance between the third item 118(3) and the side surface 124, to indicate that the first item 118(1) is to be moved out of the tote 104 before the second item 118(2) and the third item 118(3). The second distance from the second item 118(2) to the side surface 124 can be less than the third distance from the third item 118(3) to the side surface 124, to indicate that the second item 118(2) is to be moved out of the tote 104 before the third item 118(3).

In some embodiments, the packaging station computing device 116 may determine that the package preparation mechanism 106 of the packaging station 110 is ready to receive a portion of elastic film 122 above the package preparation mechanism 106. The portion of elastic film 122 that is received above the package preparation mechanism 106 may be obtained (e.g., provided) by any process suitable for identifying elastic film and utilizing the elastic film to provide the portion of the elastic film 122 above the package preparation mechanism 106. For example, the portion of elastic film 122 may be obtained from elastic film that is provided on a roll and/or spool (e.g., spool 108), elastic film that is provided as a flat sheet, elastic film that is provided as a folded sheet, etc. The portion of elastic film 122 may be obtained from elastic film provided by an operator of the packaging station 110, elastic film that is positioned in any location within, nearby, and/or around the packaging station 110, etc.

By way of example, the portion of the elastic film 122 can be obtained as a piece (e.g., brick, length, etc.) of elastic film among a stack of pieces of elastic film. The piece of elastic film can be any shape and/or size suitable for partially or fully covering a top surface of the package preparation mechanism 106. For example, a shape of the piece of elastic film can be, but is not limited to being, a circular shape, an oval shape, a square shape, or a rectangular shape. The shape of the piece of elastic film can be the same shape (e.g., with the same or different respective proportions) as a shape of the upper surface of the package preparation mechanism 106.

As pertaining to the piece of elastic film and the upper surface of the package preparation mechanism 106 both having the circular shape, the size of the piece of elastic film can be, but is not limited to being, the same or different (e.g., smaller or larger) than the size of the upper surface of the package preparation mechanism 106. For example, a diameter the piece of elastic film can be the same or different than a diameter of an outside surface (e.g., edge) of the upper surface of the package preparation mechanism 106. As pertaining to the piece of elastic film having the square shape and the upper surface of the package preparation mechanism 106 having the circular shape, a width of the piece of elastic film can be, but is not limited to being, the same or different (e.g., smaller or larger) than the diameter the outside surface of the upper surface of the package preparation mechanism 106. In some examples, any portions of the piece of elastic film that extend beyond the outside surface of the upper surface of the package preparation mechanism 106 can be cut (e.g., sheared, torn, thermally separated, etc.) and separated from a portion of the piece of elastic film that is positioned above the package preparation mechanism 106. The portions of the piece of elastic film that extend beyond the outside surface of the upper surface can be cut at any time after the piece of elastic film is positioned on the package preparation mechanism 106 and before the final sealed package is delivered to a customer. In other examples, any portions of the piece of elastic film that extend beyond the outside surface of the upper surface of the package preparation mechanism 106 can be allowed to remain without being cut and separated.

A determination that the packaging station 110 is ready to receive the portion of elastic film 122 may be based on, for example, at least one of the one or more items 118 being sensed or an input being received from the operator, via the I/O interface 818(2). The packaging station computing device 116 may perform an operation including, but not limited to, at least one of controlling the spool 108 to rotate, outputting an indicator that the packaging station 110 is ready for the spool 108 of elastic film to be rotated to position the portion of elastic film 122, or temporarily ceasing subsequent operations until a determination to resume is made based on the portion of elastic film 122 being positioned above the package preparation mechanism 106. By way of example, the determination to resume may be based on, but is not limited to, at least one of a sensor signal (e.g., signal from one of the data collection mechanisms) indicating that an amount of rotation of the spool 108 has exceeded a predetermined amount, a sensor signal (e.g., signal from one of the data collection mechanisms) indicating the portion of elastic film 122 is positioned above the package preparation mechanism 106, or a sign based on input from the operator is received, via the I/O interface 818(2).

In some embodiments, the spool 108 may be controlled to rotate to dispense the elastic film 120 and position the portion of elastic film 122 above the package preparation mechanism 106. By way of example, the spool 108 may be controlled to rotate to position the portion of elastic film 122, based on the one or more items 118 being received and/or scanned. The spool 108 may be controlled to rotate automatically by the robotic arm 102 and/or an automated rotation mechanism of the spool 108 (e.g., motor of the spool 108 that is controlled to rotate) or may be manually controlled by the operator to rotate. The portion of elastic film 122 may be positioned above the package preparation mechanism 106 based on the elastic film 120 being automatically manipulated by the robotic arm 102 or manually manipulated by the operator. By way of example, a spool of elastic film that is opposite the spool dispensing the elastic film 120 may be controlled to rotate to retrieve the elastic film 120, as the portion of elastic film 122 is being positioned above the package preparation mechanism 106. The spool 108 (e.g., spool that dispenses the elastic film) may include an undispensed (e.g., new/unused) portion of elastic film. The spool that retrieves the elastic film may include a dispensed (e.g., spent/used) portion of the elastic film 108, which is dispensed by the spool 108.

In some embodiments, the portion of elastic film 122 may be positioned above the package preparation mechanism 106, prior to the one or more items 118 being received and/or scanned. The packaging station computing device 116 may determine that the intake area 112 of the packaging station 110 is ready to receive items based on, but not limited to, at least one of a signal indicating that an amount of rotation of the spool 108 has exceeded a predetermined amount, a signal received from at least one of the one or more data collection mechanisms indicating the portion of elastic film 122 is positioned above the package preparation mechanism 106, or an input received from the operator, via the I/O interface 818(2). Based on a determination that the package preparation mechanism 106 of the packaging station 110 is ready to receive items, the packaging station computing device 116 may perform at least one operation including, but not limited to, outputting an indication to the operator via the I/O interface 818(2), temporally ceasing subsequent operations until the one or more items 118 are received at the intake area 112 and scanned, or transmitting a signal to the centralized control system to indicate the packaging station 110 is ready to receive and scan items. If a signal is received from at least one of the one or more data collection mechanisms based on the one or more items 118 being detected as having been received in the intake area 112, the packaging station computing device 116 may perform operations including scanning the one or more items 118 and determining that the one or more items 118 are ready to be transported from the tote in the intake area 112 to the package preparation mechanism 106 in the package preparation area 114.

Although one spool (e.g., spool 108) may be utilized to position the portion of the elastic film 122 above the package preparation mechanism 106, a number of spools utilized to position the portion of the elastic film 122 is not limited to one. In some examples, more than one spool may be utilized to dispense the elastic film 120. The more than one spool utilized to dispense the elastic film 120 may be positioned on a carousel. The spools on the carousel may include elastic films with the same or different characteristics (e.g., thicknesses, materials, sizes, colors, transparency, etc.). In other examples, more than one spool utilized to position the portion of the elastic film 122 may include a pair of spools. The pair of spools may include a spool that is controlled to rotate to dispense the elastic film and a spool that is positioned opposite the spool that dispenses the elastic film. The spool positioned opposite the spool that dispenses the elastic film may be controlled to rotate to retrieve the elastic film that is dispensed. In other examples, multiple pairs of spools may be utilized, including more than one spool on a carousel to dispense elastic film, and more than one corresponding spool on a carousel to retrieve the corresponding elastic film that is dispensed. The carousel with the more than one spool to dispense the elastic film may be positioned, with respect to the container, opposite to the carousel with the more than one spool to retrieve the elastic film that is dispensed. Each of the pairs of spools may include elastic films with the same or different characteristics (e.g., thicknesses, materials, sizes, colors, transparency, etc.) as other pairs of spools.

Figure 2:
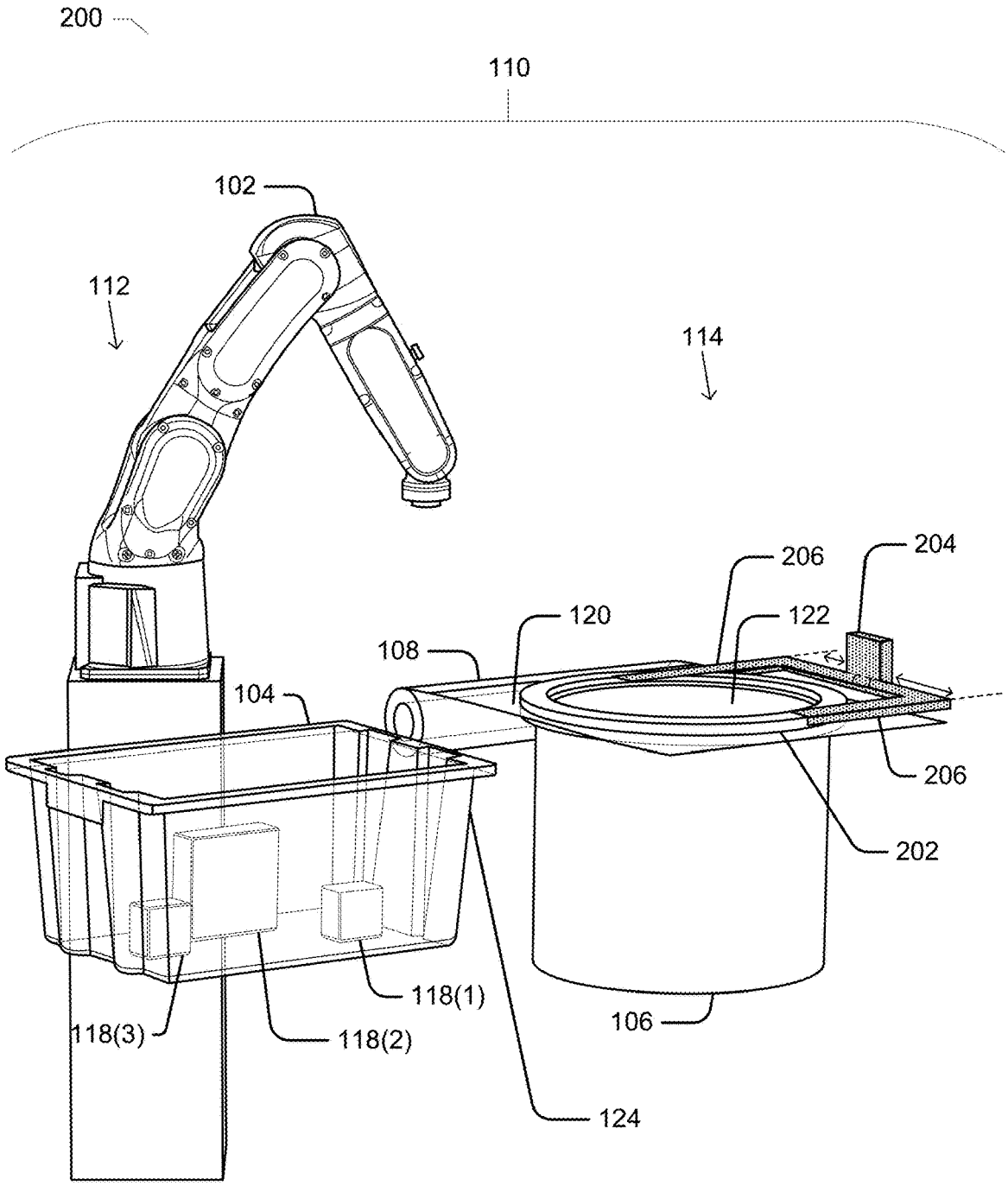
FIG. 2 illustrates an example workspace for providing a clamp above a portion of the elastic film, according to an embodiment of the present disclosure.

FIG. 2 illustrates an example workspace 200 for providing a clamp 202 above a portion of the elastic film 120, according to an embodiment of the present disclosure. A clamp 202 may be moved and positioned above a surface of the portion of the elastic film 120 (e.g., top surface of the portion of elastic film 122), which may be positioned above a container (an example of container 304 described below in connection with FIG. 3) of the package preparation mechanism 106. The top surface of the portion of the elastic film 122 on which the clamp 202 is positioned may be, for example, a ring-shaped surface of the center portion of the portion of the elastic film 122 above the container 304. A clamp positioning mechanism (e.g., vise grip) 204 may be detachably coupled to the clamp 202 to move and position the clamp 202 above the package preparation mechanism 106.

The clamp 202 may be positioned on a surface (e.g., top surface) of the portion of elastic film 122 that is opposite to surface (e.g., bottom surface) of the portion of elastic film 122 that is positioned on the package preparation mechanism 106. A top surface of the package preparation mechanism 106 may include a lip (e.g., top surface of the container 304). The elastic film 122 may be positioned in a substantially planar orientation over the opening of the container 304. The bottom surface of the portion of elastic film 122 may be positioned against an inner surface of the lip (e.g., top surface of the container 304). The clamp 202 may restrain (e.g., restrict, prevent) movement of the portion of elastic film 122. The clamp 202 may apply pressure to the portion of the elastic film 122 to create an air tight seal between the portion of the elastic film 122 and the top surface of the container 304. The vise grip 204 may apply pressure (e.g., be controlled based on a force applied in a downward direction) on the clamp 202 in a direction of the portion of elastic film 122. The vise grip 204 may be automatically and/or manually controllable to grip or adhere to the clamp 202.

By way of example, the vise grip 204 may have arms 206. Each of the arms 206 may have an inside surface that is positioned adjacent to (e.g., against) an exterior side surface of the clamp 202, to apply pressure in a downward direction, and an inward direction to grasp the clamp 202. Each of the arms 206 of the vise grip 204 may include a bottom surface that covers a portion of a top surface of the clamp 202, to press down on the clamp 202.

In a scenario in which the portion of elastic film 122 is determined to be positioned above the container 304, the packaging station computing device 116 may determine the portion of elastic film 122 is ready to receive the clamp 202. In some examples, the packaging station computing device 116 may determine the portion of elastic film 122 is ready to receive the clamp 202 based on the portion of elastic film 122 being determined to be positioned above the container 304 and the one or more items 118 being determined to be positioned in the intake area 112. By way of example, the vise grip 204 may be controlled to close the arms 206 together to clasp the clamp 202, based on the camp 202 being positioned an area near the package preparation area 114, and maneuver the clamp 202 to the position above the portion of elastic film 122. The arms 206 of the vise grip 204 may apply a downward force on the clamp 202 and the portion of elastic film 122, the force being applied in a direction of the package preparation mechanism 106. In some examples, the vise grip 204 may controlled by the robotic arm 102, another robotic arm positioned in, or near, the packaging station 110, or another mechanism (e.g., induct mechanism) via the operator of the packaging station 110. The clamp 202 may be controlled to remain motionless (e.g., continuously apply force in a downward direction).

For example, the clamp 202 may be controlled by a mechanism including, but not limited to, the robotic arm 102, another robotic arm positioned in, or near, the packaging station, and/or another mechanism manually or automatically controlled by the operator of the packaging station. The clamp 202 may be positioned above the container 304 to restrain movement of the portion of elastic film 122, to allow the center portion of the portion of elastic film 122 to expand based on a vacuum that is created in the container 304, to allow the center portion of the portion of elastic film 122 to be contracted based on the vacuum being released, and to separate the portion of elastic film 122 from a remaining portion of the elastic film 120.

In some embodiments, the clamp 202 may be directly controlled, without the vice grip 204, to be transported and positioned onto the portion of the elastic film 122. The clamp 202 may be automatically and/or manually controlled via any mechanism suitable for the clamp 202 to be positionable and/or to exert a downward force. In some examples, the clamp 202 may be automatically and/or manually controlled via a robotic mechanism (e.g., an example of one of robotic mechanisms 808 described below in connection with FIG. 8) that is directly and/or permanently coupled to the clamp 202. In other examples, the clamp 202 may be manually (e.g., directly or indirectly) controlled by another mechanism (e.g., induct mechanism) via the operator of the packaging station 110.

In some embodiments, after the clamp 202 is positioned above the container 304, the portion of elastic film 122 may be separated from a remaining portion of the elastic film 120. The portion of elastic film 122 may be separated by any process suitable for allowing the portion of elastic film 122 to remain on the container 304, after the remaining portion of the elastic film 120 is removed. For example, the portion of elastic film 122 may be separated (e.g., cut, torn, thermally separated, etc.) by utilizing a knife, scissors, heat applicator wand tool, etc. The portion of elastic film 122 may be separated automatically by the robotic arm 102 and/or manually by the operator of the packaging station 110. The portion of elastic film 122 may be separated during the process of packaging the one or more items 118 at any time after the clamp 202 is positioned on the container 304.

Figure 3:
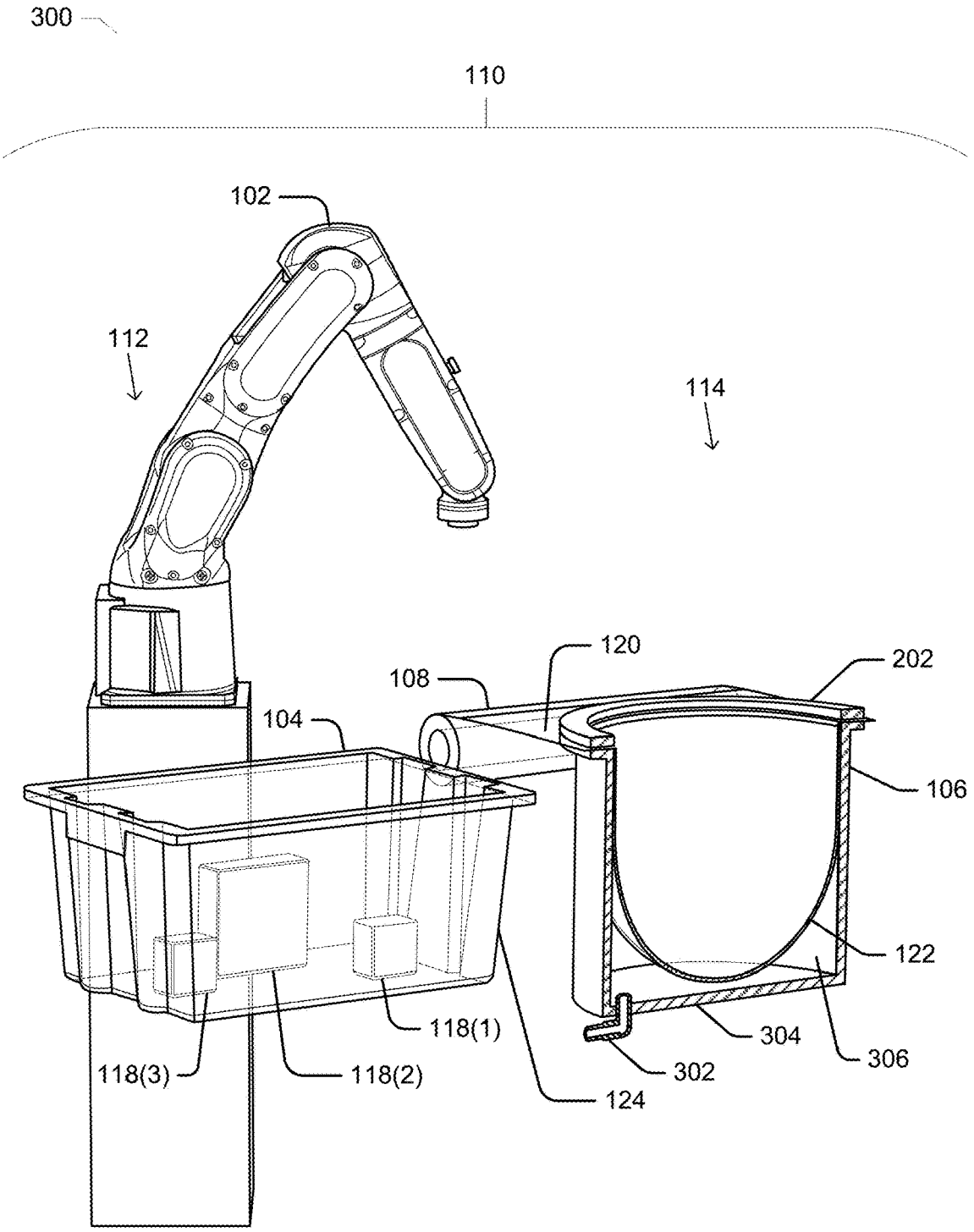
FIG. 3 illustrates an example workspace for activating a valve coupled to a container on which a portion of elastic film is positioned, to extract air from a cavity of the container.

FIG. 3 illustrates an example workspace 300 for activating a valve 302 coupled to a container 304 on which a portion of elastic film 122 is positioned, to extract air from a cavity 306 of the container 304, according to an embodiment of the present disclosure. The package preparation mechanism 106 may include the container 304 and the valve 302 (e.g., air flow control mechanism) located at the container 304. The valve 302 may be located at a surface (e.g., bottom surface, side surface, etc.) of the container 304. By way of example, the valve 302 may be located at the bottom surface of the container 304. The valve 302 may be located near a corner or edge between the bottom surface and the side surface of the container 304. The valve 302 may include an end within a cavity (e.g., interior area) 306 of the container 304 and an end that is in an area that is external to (e.g., outside) the container 304. The valve 302 may be coupled to an air flow routing mechanism (e.g., hose, tube, pipe, etc.), which may be coupled to an air pump. In some examples, the valve may be coupled directly to the air pump. The air pump may be controlled to extract air from the container and/or pump air into the container.

Although one valve (e.g., valve 302) may be utilized to allow air to flow out of (or to extract air from), and/or into, the container 304, a number of valves coupled to the container is not limited to one. For example, any number of valves may be coupled to the container and controlled to operate, in unison or independently, with the valve described above.

In a scenario in which the position of the clamp 302 on the portion of elastic film 102 is fixed above the container 304, the packaging station computing device 116 may determine that a center portion of the portion of elastic film 122 is ready to be expanded in the cavity 306 of the container 304. Determining the center portion of the portion of elastic film 122 is ready to be expanded in the cavity 306 may include determining that the clamp 202 is pressing down on the portion of elastic film 122 and creating an airtight seal between the portion of elastic film 122 and a top perimeter of the container 304. The packaging station computing device 116 may control the valve 302 to be opened (e.g., activated) to allow air to be extracted from the cavity 306. The air may be extracted from the cavity 304 to create a vacuum within the cavity 304.

In some examples, the vacuum may be created in the cavity 306 based on the valve 302 being opened and coupled to an air pump that is controlled to extract air from the cavity 306. The vacuum may be created in the cavity 304 based on the air being extracted to allow the center portion of the portion of elastic film 122 positioned above the container 304 to stretch and/or expand, such that the center portion of the portion of elastic film 122 extends downward into the cavity 306 of the container 304. A void may be created in the center portion of the portion of elastic film 122, based on the center portion being stretched and/or expanded (e.g., extended downward). The center portion of the portion of elastic film 122 may be allowed to expand to have an area that is a portion of a total area of the cavity 306 of the container 304. The center portion of the portion of elastic film 122 may be allowed to expand to have an area that is less than the total area of the cavity 306.

In some examples, the center portion of the portion of elastic film 122 may be allowed to expand until an area of a void of the center portion of the portion of elastic film 122 exceeds a threshold area. The threshold area may correspond to a percentage (e.g., 80%, 85%, 90%, 95%, etc.) of the total area of the cavity 306. The void may be created between the center portion and an opening of the container 304 to create space in the center portion to allow the one or more items 118 to be placed into that space. The void will constitute an interior of a package that will contain the one or more items 118. By way of example, a size (e.g., area) of a cross section (e.g., horizontal cross section in a plane aligned with the top surface of the container 304) of the void at an opening in a top surface of the container 304 may be substantially equal to, or larger than, a size (e.g. area) of any cross section (e.g., another cross section parallel to the horizontal cross section in a plane aligned with the top surface of the container 304) of the void below the opening in the top surface of the container 304. As pertaining to the piece of elastic film and the upper surface of the package preparation mechanism 106 both having the circular shape, a diameter of the cross section of the void at the opening in the top surface of the container 304 may be substantially equal to, or larger than, a diameter of any cross section of the void below the opening in the top surface of the container 304.

By providing the cross section of the void at the opening in the top surface with the size that is equal to, or larger than, the size of any cross section of the void below the opening in the top surface of the container 304, items can be easily placed in the void. The items can be placed without a mechanism used to transport the items into the void having to be cautiously and delicately controlled. The mechanism can easily place items without concern about a rotation (e.g., orientation) of the items. The items can be transported to the void and allowed to naturally settle into place without requiring additional assistance, according to weights, dimensions, and materials of the items.

In some examples, the packaging station computing device 116 may provide an indication to the operator via the I/O interface 818(2) to activate the valve 302. The indication to the operator to activate the valve 302 may be provided based on a determination that the center portion of the portion of elastic film 122 is ready to be expanded in the cavity 306. The packaging station computing device 116 may temporarily cease subsequent operations, based on the determination that the center portion of the portion of elastic film 122 is ready to be expanded. The subsequent operations may be temporarily ceased until an input is received from the operator via the I/O interface 818(2) to indicate that the valve 302 has been opened (e.g., activated) to extract the air (e.g., allow the air to be removed from the cavity 306). The packaging station computing device 116 may control the valve 302 to be closed (e.g., deactivated) as the center portion of the portion of elastic film 122 expands. The valve 302 may be controlled to be closed (e.g., deactivated) based on a determination that an area of a portion of the cavity 306 between the container 304 and the center portion of the portion of elastic film 122 decreases to less than a threshold area. The area of the portion of the cavity 306 between the container 304 and the center portion of the portion of elastic film 122 may be maintained to be equal to, or greater than, the threshold area. By maintaining the area of the portion of the cavity 306 between the container 304 and the center portion of the portion of elastic film 122, the vacuum in the cavity 306 is maintained to prevent the center portion of the portion of elastic film 122 from contacting the valve 302.

In some examples, the area of the cavity 306 may be maintained to be greater than the threshold area to prevent a distance between the center portion of the portion of elastic film 122 and the valve 302 from decreasing below a threshold distance (e.g., 0.5 inches, 1 inch, etc.). The packaging station computing device 116 may control the valve 302 to be closed (e.g., deactivated) based on at least one of a signal from the I/O interface 818(2) based on input from the operator, a signal from a sensor in the cavity 306 indicating that the distance between the center portion of the portion of elastic film 122 and the valve 302 decreases to less than the threshold distance, or a signal from a timer that senses that an amount of time that lapses from when the valve 302 is opened (e.g., activated) exceeds a threshold time.

Figure 4:
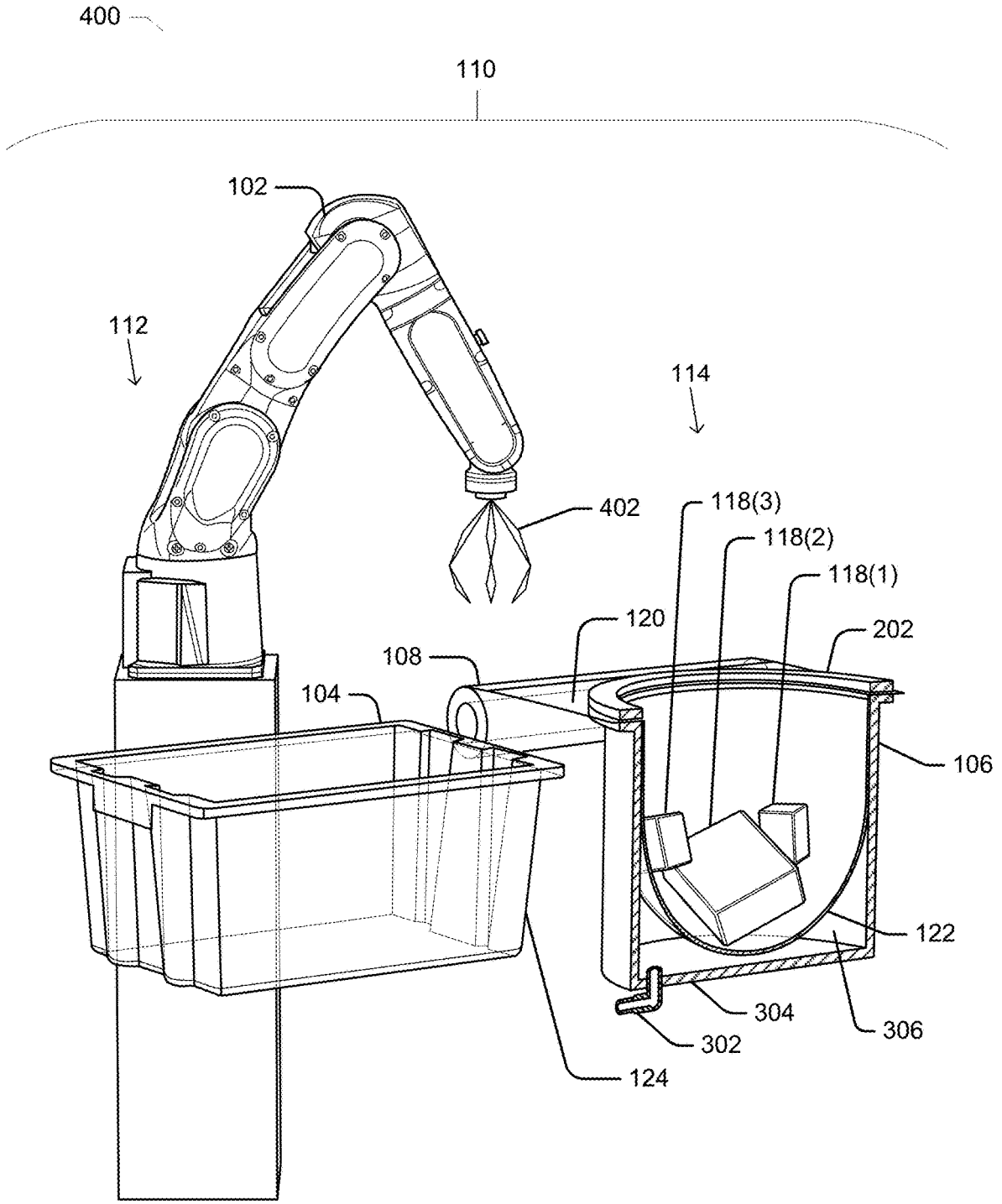
FIG. 4 illustrates an example workspace for moving one or more items into a void in a center portion of a portion of elastic film above a container, according to an embodiment of the present disclosure.

FIG. 4 illustrates an example workspace 400 for moving one or more items 118 into a void in a center portion of a portion of elastic film 122 above a container 304, according to an embodiment of the present disclosure. The robotic arm 102 may be detachably or permanently coupled to a robotic carrying mechanism (e.g., claw, vise grip, suction cup, etc.) 402.

In a scenario in which the center portion of the portion of elastic film 122 above the container 304 is determined as having been expanded in the cavity 306 of the container, the packaging station computing device 116 may determine that the one or more items 118 are ready to be transported from the intake area 112 to the package preparation area 114. The packaging station computing device 116 may control the robotic arm 102 to operate the robotic carrying mechanism 402 and detachably couple the robotic carrying mechanism 402 with at least one of the one or more items 118. The packaging station computing device 116 may control the robotic arm 102 to sequentially (e.g., individually) move the first item 118(1), the second item 118(2), and the third item 118(3) from the tote 104 to the container 304.

If the one or more items 118 are in a sorted order, the packaging station computing device 116 may control the robotic arm 102 to transport the one or more items 118 to the container, based on a determination that the one or more items 118 have been received and are positioned in the tote 104. By way of example, the packaging station computing device 116 may control the robotic arm 102 to transport, in order, the first item 118(1), the second item 118(2), and the third item 118(3) that are sorted. If the one or more items 118 are in an unsorted order, the packaging station computing device 116 may control the robotic arm to transport the one or more items 118 to the container, based on a determination that the one or more items 118 have been received and positioned in the tote 104, and further based on the identification information and/or the characteristics of the one or more items 118. The identification information and/or the characteristics of the one or more items 118 that are unsorted may be utilized to determine an order in which the one or more items 118 are moved to the container 304. The identification information may include at least one of a serial number, a product number, a model number, a brand name, a model name, etc. The characteristics may include at least one of a size, a weight, a level of fragility, etc. By way of example, the item 118(2), which has a larger size than the item 118(1) and the item 118(3), may be moved into the container before the item 118(1) and the item 118(3). By moving an item among the one or more items 118 that is larger than remaining items (e.g., item 118(2)) to the container first, a stability and/or durability of a sealed package that includes all of the one or more items 118 may be improved. The sealed package may be easily transported and/or delivered since the sealed package has a stable surface based on the item 118(2) on which the sealed package may be placed. The sealed package may more reliably and securely transported and/or delivered since a number of rough and/or sharp edges of any of the one or more items 118 that are in contact the center portion of the portion of the elastic film 122 is minimized. A likelihood of a tear in the center portion of the portion of the elastic film 122 during transportation and/or delivery is reduced. Reducing the likelihood of the tear reduces a likelihood of disruption to one or more capability(s) of the sealed package for containing (e.g., restricting) movement of the one or more items 118, preventing damage to the one or more items 118 due to moisture, etc. In other examples, if the one or more items 118 are in a sorted order, the packaging station computing device 116 may control the robotic arm 102 to transport the one or more items 118 that are sorted further based on the identification information and/or the characteristics of the one or more items 118. The void may be created between the center portion and an opening of the container 304 based on a vacuum being created in the container 304. The void may be created to create space in the center portion to allow the one or more items 118 to be placed into that space. The void will constitute an interior of a package that will contain the one or more items 118. The void will be maintained in the center portion until the vacuum is released and the center portion contracts to enclose the one or more items 118 in a package that will subsequently transfer the item(s) 118 to a different area or location (e.g., a delivery address/destination of a customer, a different facility or warehouse that assembles or distributes items 118, etc.).

Figure 5:
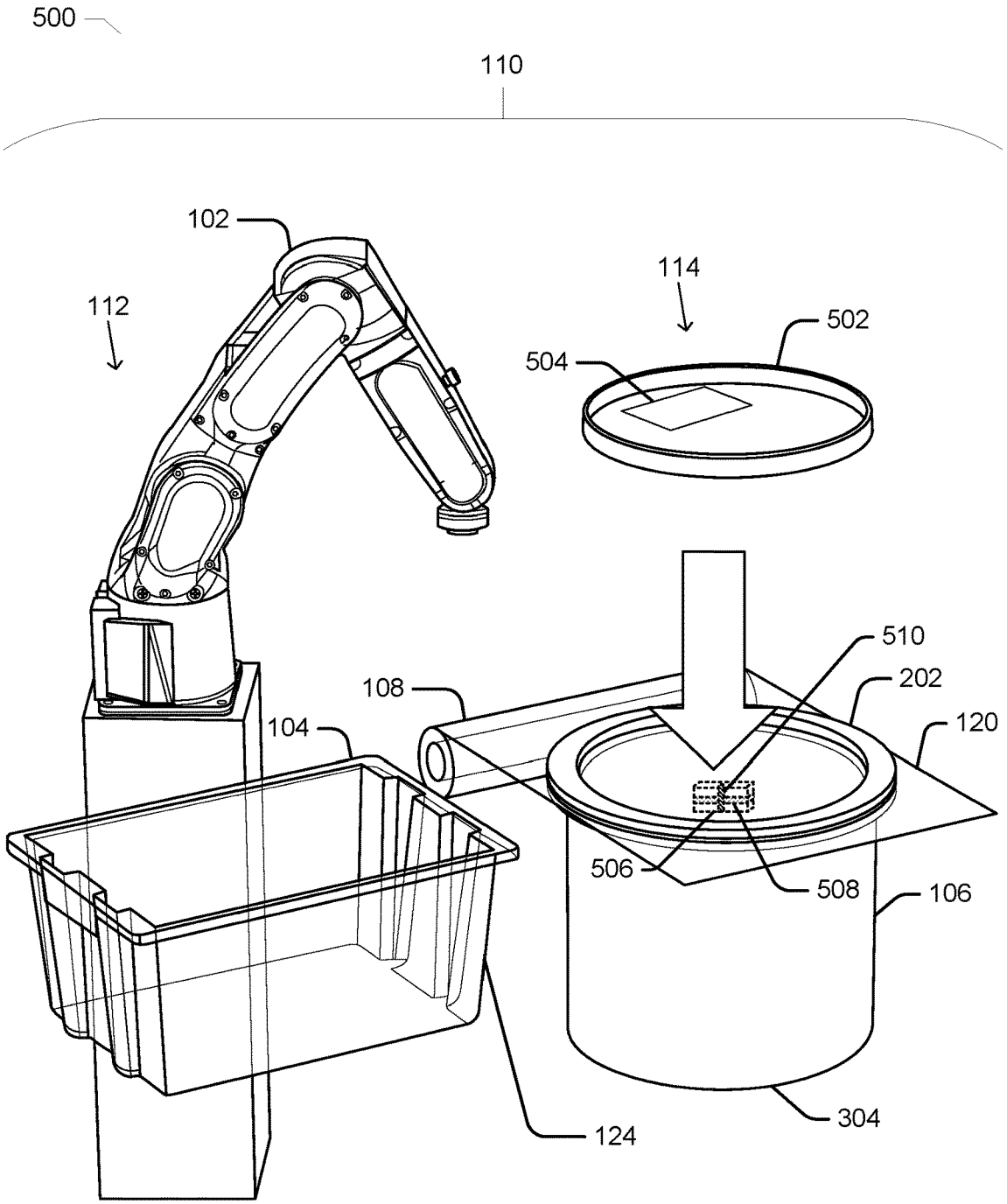
FIG. 5 illustrates an example workspace for positioning a cover in an opening of an upper surface of a container and adhering a portion the cover to a portion of elastic film, according to an embodiment of the present disclosure.

FIG. 5 illustrates an example workspace 500 for positioning a cover 502 in an opening of a top surface of a container 304 and adhering a portion the cover 502 to a portion of the elastic film 120, according to an embodiment of the present disclosure. The cover 502 may include a side surface, which may be adhered to a side surface of the portion of the elastic film 120. By way of example, a portion of an outer (e.g., exterior) side surface of the cover 502 may be adhered to a portion (e.g., initial adhering portion of elastic film) of an inner side surface of the portion of elastic film 122 (e.g., inner side surface of the center portion of the portion of elastic film 122). A label 504 (e.g., shipping label) may be adhere to the cover 502. A height of the inner side surface of the portion of elastic film 122 may be substantially equal to a height of the outer side surface of the cover 502 (e.g., an absolute value of a difference between the height of the inner side surface of the portion of elastic film 122 and the height of the outer side surface of the cover 502 may be a percentage of the height of the outer side surface of the cover 502, the percentage being less than a threshold percentage (e.g., 5%, 10%, etc.).

In some embodiments, the packaging station computing device 116 may determine that the container 304 is ready to be sealed by a sealing mechanism including the cover 502 or a twist tie mechanism (e.g., clasp, rope, etc.). Determining that the container 304 is ready to be sealed may include determining that the one or more items 118 are placed within the void of the center portion of the portion of elastic film 122. For instance, once it is determined that all of the one or more items 118 intended to be packaged together have been placed within the container 304, then a cover can be placed in the opening of the container 304 to seal the items between the center portion and the cover. By way of example, the packaging station computing device may operate in a cover sealing mode or a twist tie sealing mode. The packaging station computing device may operate in the cover sealing mode to seal the container 304 with the cover 502. The packaging station computing device 116 may operate in the twist tie sealing mode to seal the container 304 with the twist tie mechanism. The packaging station computing device 116 may be set to operate in the cover sealing mode or the twist tie sealing mode, based on input from the operator via the I/O interface 818(2).

In a scenario in which the packaging station computing device 116 is being operated in the cover sealing mode, the packaging station computing device may determine that the container 304 is ready to be covered and sealed with the cover 502, based on determining that the one or more items 118 have been placed in the container 304. By way of example, the packaging station computing device 116 may determine that all of the one or more items 118 have been placed in the container 304 by determining that a number of the one or more items 118 that have been moved to the container 304 is equal to a total number of the one or more items 118. The packaging station computing device 116 may determine that the one or more items 118 have been placed in the container based on a signal received from at least one of the one or more data collection mechanisms. The signal may indicate that all of the one or more items 118 have been retrieved from the tote 104 and placed in the container 304, a determination that all of the one or more items 118 have been scanned and placed in the container, and/or a signal from the I/O interface based on input received from the operator.

In some embodiments, the packaging station computing device 116 may determine that the container 304 is ready to be covered with the cover 502 further based on determining that a distance from the opening of the top surface of the container 304 to a highest portion of any the one or more items 118 in the container 304 is less than a threshold distance. The distance from the opening of the top surface of the container 304 to the highest portion of any the one or more items 118 in the container 304 may be determined based on at least one signal received from at least one of the data collection mechanisms. In some examples, the packaging station computing device 116 may determine that the container 304 is ready to be covered with the cover 502 further based on signal that is based on input from the operator and that indicates that the distance from the opening of the top surface of the container 304 to the highest portion of any the one or more items 118 is less than the threshold distance. The packaging station computing device 116 may, based on determining the one or more items 118 have been placed in the container, and/or further based on determining the distance from the opening of the top surface of the container 304 to the highest portion of any the one or more items 118 is less than the threshold distance, temporarily cease operations to allow the operator to position the cover 502 on the container 304, output an indication via the I/O interface instructing the operator to position the cover on the container, and/or control the robotic arm 102 to be detachably coupled to the cover 502 to position the cover 502 on the container 304.

In some embodiments, the cover 502 may be sealed to the center portion of the portion of elastic film 122 by adhering the portion of the outer (e.g., exterior) side surface of the cover 502 to the initial adhering portion of elastic film. The cover may be adhered to the elastic film by any adhering mechanism suitable for firmly attaching the cover to the elastic film. For example, the adhering mechanism may include, but is not limited to, an adhesive (e.g., glue, paste, etc.), a thermal bond between the cover and the elastic film formed by applying heat to melt the cover and the elastic film together, etc. The cover and the elastic film may be melted together by any type of heat application mechanism including, but not limited to, a hot melt glue gun. The hot melt glue gun may provide a temperature to an area between the cover and the elastic film of, for example, 350 degrees.

In some embodiments, the cover 502 that is positioned on the container 304 may be sealed before and/or as the vacuum in the cavity 306 is released as part of a one-stage sealing process or a two-stage sealing process. As pertaining to the one-stage sealing process, an outside surface of a side surface of the cover 502 can be partially (e.g., discretely, non-hermetically, etc.) sealed to the center portion of the portion of elastic film 122. For example, the outside surface of the side surface of the cover 502 can be partially and permanently sealed in such a way that remaining portions of the side surface of the cover 502 that are not adhered to the center portion before the vacuum in the cavity 306 is released, are not adhered to the center portion in the sealed package for delivery. The cover 502 can be fully (e.g., completely, hermetically, etc.) sealed to the center portion of the portion of elastic film 122. The outside surface of the side surface of the cover 502 can be fully sealed in such a way that all portions of the outside surface of the side surface of the cover 502 are adhered to the center portion before the vacuum in the cavity 306 is released. The cover 502 as described above can be a porous material that allows air to be released through the center portion of the portion of elastic film 122 (e.g., as the vacuum is released).

As pertaining to the two-stage sealing process, the cover 502 can be partially sealed to the center portion of the portion of elastic film 122. In a first stage, the outside surface of the side surface of the cover 502 can be partially sealed. The outside surface of the side surface of the cover 502 can be partially sealed in such a way that at least one portion of the side surface of the cover 502 is not adhered to the center portion as and/or before the vacuum in the cavity 306 is released. Some or all of the at least one portion of the side surface of the cover 502 that is not adhered to the center portion can be subsequently adhered to the center portion in a second stage as and/or after the vacuum is released. The cover 502 as described above can be a porous or non-porous material.

In a scenario in which the packaging station computing device 116 is being operated in the twist tie sealing mode, the packaging station computing device 116 may determine a package including the one or more items 118 is ready to be rotated instead of utilizing the cover 502. The packaging station computing device 116 may determine the center portion of the portion of elastic film 122 is ready to be rotated (e.g., turned) based on determining that the one or more items 118 have been placed in the container 304. The packaging station computing device 116 may determine that the one or more items 118 have been placed in the container 304 in a similar way as for the cover sealing mode, described above. The center portion of the portion of elastic film 122 may be rotated to partially seal the center portion of the portion of elastic film 122 that includes the one or more items 118, via a twisted portion 506 of elastic film between the clamp and a portion of the center portion of elastic film that include the items. A clasp 508 may be placed around the twisted portion 506. A straw or tube 510 may be placed in the center portion of the elastic film 122 as the center portion is rotated. The packaging station computing device 116, based on determining the one or more items 118 have been placed in the container 304, may temporarily cease operations to allow the operator to cause the center portion of elastic film 122 to be partially rotated (e.g., rotation causing the center portion of the portion of elastic film 122 to be partially sealed), output an indication via the I/O interface 812(2) instructing the operator to cause the center portion of elastic film 122 to be partially rotated, and/or provide an input via the I/O interface 812(2) to control a robotic mechanism (e.g., an example of one of robotic mechanisms 808 described below in connection with FIG. 8) associated with the container 304 (e.g., coupled to container 304, integrated with container 304, positioned within the container 304, etc.) to grip and partially rotate the center portion of elastic film 122. The robotic mechanism (herein referred to as "robotic arm") associated with the container 304 may utilize any arm extension mechanism suitable for gripping and rotating the center portion. For example, the robotic arm associated with the container 304 may be coupled to an arm extension mechanism including, but not limited to, a robotic claw, a robotic clamp, etc. The twisted portion may be partially sealed based on the center portion of the portion of elastic film 122 being partially rotated, by applying the twist tie mechanism to the twisted portion with the straw or tube placed in the twisted portion or by pinching together the twisted portion with the straw or tube placed in the twisted portion.

Figure 6:
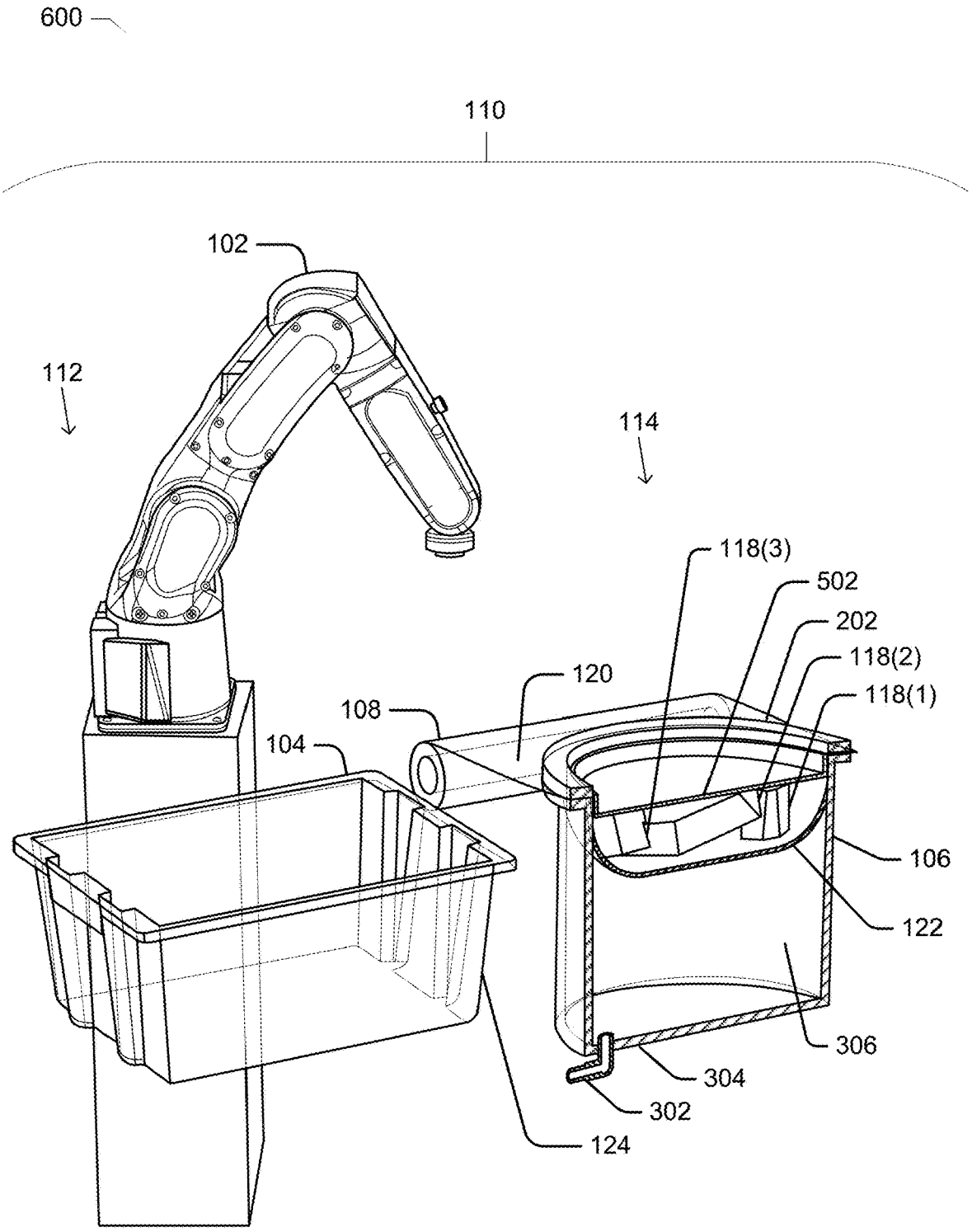
FIG. 6 illustrates an example workspace for activating a valve to allow air to flow into a cavity of a container to seal a package with one or more items, according to an embodiment of the present disclosure.

FIG. 6 illustrates an example workspace 600 for activating a valve 302 to allow air to flow into a cavity 306 of a container 304 to seal a package with one or more items 118, according to an embodiment of the present disclosure. The cover 502 may be positioned in the opening of the top surface of the container 304. The cover 502 may be sealed (e.g., partially sealed) to an opening of the container 304 as the air flows into the container 304 and vacuum is released. A portion of an outer (e.g., exterior) side surface of the cover 502 may be adhered (e.g., partially adhered) to a portion (e.g., initial adhering portion of elastic film) of an inner side surface of the center portion of the portion of elastic film 122 (e.g., inner side surface of the portion of elastic film 122). The cover 502 may be partially sealed to the opening of the container 304 based on the portion of the outer side surface of the cover 502 being adhered to the initial adhering portion of elastic film.

In some embodiments, the packaging station computing device 116 may determine that the package preparation mechanism 114 is ready to have the valve opened (e.g., activated) to release the vacuum from the cavity 306 of the container 304. In some examples, the vacuum may be released from the cavity 306 based on the valve 302 that is opened being coupled to an air pump that is controlled to provide air flow into the cavity 306. In some examples, the vacuum may be released from the cavity 306 based on the valve 302 that is opened providing access for the cavity 306 to air outside of the container 304. The packaging station computing device 116 may determine that the package preparation mechanism 114 is ready to have the valve opened based on determining that the cover 502 is positioned on the container 304 and/or determining that the portion of the outer side surface of the cover 502 is adhered to the initial adhering portion elastic film. By way of example, the packaging station computing device 116 may determine that the cover is place on the container, and/or partially adhered to the portion of the interior surface of the center portion of the portion of elastic film 122, based on determining the robotic arm has positioned the cover and/or input received from the operator via the I/O interface of the packaging station computing device 116. Based on determining the package preparation mechanism is ready to have the valve opened (e.g., activated), the packaging station computing device 116 may temporarily cease operations to allow the operator to activate the valve 302, output an indication via the I/O interface instructing the operator to activate the valve 302, and/or control (e.g., automatically/electrically) the valve 302 to be opened (e.g., activated) to release the vacuum in the cavity 306 and to remove (e.g., decrease and eliminate) the void in the center portion of the portion of elastic film 122. By way of example, the valve 302 is opened to allow air to flow into (e.g., return to) the cavity 306. The void in the center portion of the portion of elastic film 122 is removed as the one or more items 116 are raised to be positioned (e.g., firmly and/or securely) against the cover 502. The center portion of the portion of elastic film 122 is allowed to contract around the item(s) 118 as the air is allowed to flow into the cavity 306. A size of the void in the center portion of the portion of elastic film 122 becomes smaller to remove the void based on the center portion of the portion of elastic film 122 being allowed to contract. As the as the one or more items 116 are positioned (e.g., firmly and/or securely) against the cover 502, movement of the one or more items 116 is prohibited (e.g., restrained and/or substantially restricted) based on the one or more items 116 being held close to (e.g., against) the cover by the center portion of the portion of elastic film 122 (e.g., tension that is created by properties of elasticity of the elastic film). An amount of potential movement of the one or more items 116 that is restricted by the portion of elastic film 122 after the vacuum is released is less than an amount of potential movement of the one or more items 116 that are restricted by the portion the elastic film 122 before the vacuum is released.

In a scenario in which the packaging station computing device 116 is being operated in the cover sealing mode, the packaging station computing device 116 may determine that the cover 502 is ready to be sealed (e.g., completely sealed) to the center portion of the portion of elastic film 122. The cover 502 may be completely sealed to the center portion of the portion of elastic film 122 by adhering a remaining portion of the outer side surface of the cover 502 to a remaining portion (e.g., remaining adhering portion of elastic film) of the inner side surface of the center portion of the portion of elastic film 122 (e.g., inner side surface of the portion of elastic film 122). In some examples the remaining portion of the outer side surface of the cover 502 may be adhered by application of an adhesive or thermal bondage. The packaging station computing device 116 may determine that the cover 502 is ready to be completely sealed, based on determining that the vacuum in the cavity 306 has been released. In some examples, the packaging station computing device 116 may determine the vacuum in the cavity 306 has been released (e.g., fully released) based on determining an air pressure of the cavity 306 is substantially equal to an air pressure of an area outside of the container 304. The air pressure of the cavity 306 may be determined as having exceeded the air pressure of the area outside of the container 304 based on a signal from a pressure sensor associated with the cavity 306 and a signal from a pressure sensor associated with the area outside of the container 304. The packaging station computing device 116 may determine that the air pressure of the cavity 306 has increased to exceed a threshold air pressure.

In some examples, the packaging station computing device 116 may determine the cover 502 is completely sealed based on a signal from at least one of the data collection mechanisms indicating that a height of a lowest portion of an outside surface of the center portion of the portion of elastic film 122 exceeds a threshold height. In some examples, the valve 302 may be closed (e.g., deactivated) based on a difference of the air pressure of the cavity 306 and the air pressure of the area outside of the container 304. The valve 302 may be closed (e.g., deactivated) based on the difference exceeding a threshold difference, to prevent the portion of elastic film 122 from compressing and damaging the one or more items 118. For example, the valve 302 may be closed (e.g., deactivated) based on the difference exceeding the threshold difference, further based on identification information and/or characteristic(s) of the one or more items 118 (e.g., the one or more items 118 being determined, based on identification information and/or characteristic(s), to be delicate, fragile, soft, pliable, etc.).

In some embodiments, the packaging station computing device 116 may, based on determining the cover 502 is ready to be completely sealed, temporarily cease operations to allow the operator to completely seal the cover 502, output an indication via the I/O interface instructing the operator to completely seal the cover 502, and/or control the robotic arm 102 to completely seal the cover 502. By way of example, the cover 502 may be completely sealed to the portion of elastic film 122 at subsequent time to the cover 502 being partially sealed to the portion of elastic film 122.

In some embodiments, the cover 502 that is positioned on the container 304 may be sealed as and/or after the vacuum in the cavity 306 is released as part of a one-stage sealing process or a two-stage sealing process. As pertaining to the one-stage sealing process, an outside surface of a side surface of the cover 502 can be sealed to the center portion of the portion of elastic film 122, based on the outside surface of the side surface of the cover 502 not having been partially or fully sealed to the center portion of the portion of elastic film 122 before and/or as the vacuum was released. The outside surface of the side surface of the cover 502 can be partially sealed to the center portion of the portion of elastic film 122. For example, the outside surface of the side surface of the cover 502 can be partially and/or permanently sealed in such a way that one or more portions of the side surface of the cover 502 are not adhered to the center portion. The cover 502 can be fully sealed to the center portion of the portion of elastic film 122. The outside surface of the side surface of the cover 502 can be fully sealed in such a way that all portions of the outside surface of the side surface of the cover 502 are adhered to the center portion as and/or after the vacuum in the cavity 306 is released. The cover 502 as described above can be a porous or non-porous material.

As pertaining to the two-stage sealing process, the cover 502 can be partially sealed or fully sealed to the center portion of the portion of elastic film 122. In a second stage, some or all of at least one portion of the side surface of the cover 502 that is not adhered to the center portion in the first stage, may be adhered to the center portion as and/or after the vacuum is released. The cover 502 as described above can be a porous or non-porous material.

In a scenario in which the packaging station computing device 116 is being operated in the twist tie sealing mode, the valve 302 may opened after the portion of elastic film 122 has been rotated (e.g., partially rotated). The valve 302 may be opened to allow air to flow into (e.g., return to) the cavity 306. The void in the center portion of the portion of elastic film 122 is removed as the one or more items 116 are raised to be positioned (e.g., firmly and/or securely) against the cover 502. The center portion of the portion of elastic film 122 is allowed to contract as the air is allowed to flow into the cavity 306. A size of the void in the center portion of the portion of elastic film 122 becomes smaller to remove the void based on the center portion of the portion of elastic film 122 being allowed to contract. The packaging station computing device 116 may determine that the center portion of the portion of elastic film 122 is ready to be sealed based on one or more signals that are received from at least one of the one or more data collection mechanisms and that indicate one or more characteristics (e.g., air pressure of the cavity 306, height of the one or more items 118, etc.) associated with the container 304 exceed corresponding one or more threshold characteristics, and/or based on input received from an operator via the I/O interface 812(2).

In some examples, a signal from the at least one of the one or more data collection mechanisms may indicate an air pressure of the cavity 306. The packaging station computing device 116 may determine that the air pressure of the cavity 306 exceeds a threshold air pressure (e.g., air pressure that is predetermined to prevent damage to the one or more items 118, air pressure that corresponds to air pressure outside of the container 304 within a predetermined tolerance, etc.). In other examples, a signal from the at least one of the one or more data collection mechanisms may indicate a height of the one or more items 118 in the container 304 (e.g., distance from a bottom portion of a lowest item among the one or more items 118, to a bottom surface of the container 304). The packaging station computing device 116 may determine that the height exceeds a threshold height (e.g., height predetermined to prevent damage to the one or more items 118). The packaging station computing device 116, based on determining the one or more items 118 have been placed in the container 304, and/or based on determining the one or more signals indicating the one or more characteristics associated with the container 304 exceed corresponding one or more threshold characteristics, may temporarily cease operations to allow the operator to cause the center portion of the portion of elastic film 122 to be fully rotated (e.g., completely rotated, to cause the portion of elastic film 122 to be sealed), output an indication via the I/O interface 812(2) instructing the operator to cause the center portion of the portion of elastic film 122 to be fully rotated, and/or provide an input via the I/O interface 812(2) to control a robotic mechanism (e.g., an example of one of robotic mechanisms 808 described below in connection with FIG. 8) associated with the container 304 (e.g., coupled to the container 304, integrated with container 304, positioned within the container 304, etc.) to grip and fully rotate the center portion of the portion of elastic film 122.

By way of example, the center portion of the portion of elastic film 122 may be caused to be completely rotated at subsequent time to the center portion of the portion of elastic film 122 being caused to be partially rotated. The robotic mechanism (herein referred to as "robotic arm") associated with within the container 304 may utilize any arm extension mechanism suitable for gripping and rotating the center portion. For example, the robotic arm associated with within the container 304 may be coupled to an arm extension mechanism including, but not limited to, a robotic claw, a robotic clamp, etc. The twisted portion may be sealed based on the portion of elastic film 122 being fully rotated, by applying the twist tie mechanism to the twisted portion or by pinching together and/or melting the twisted portion (e.g., applying a hot melt glue gun).

Figure 7:
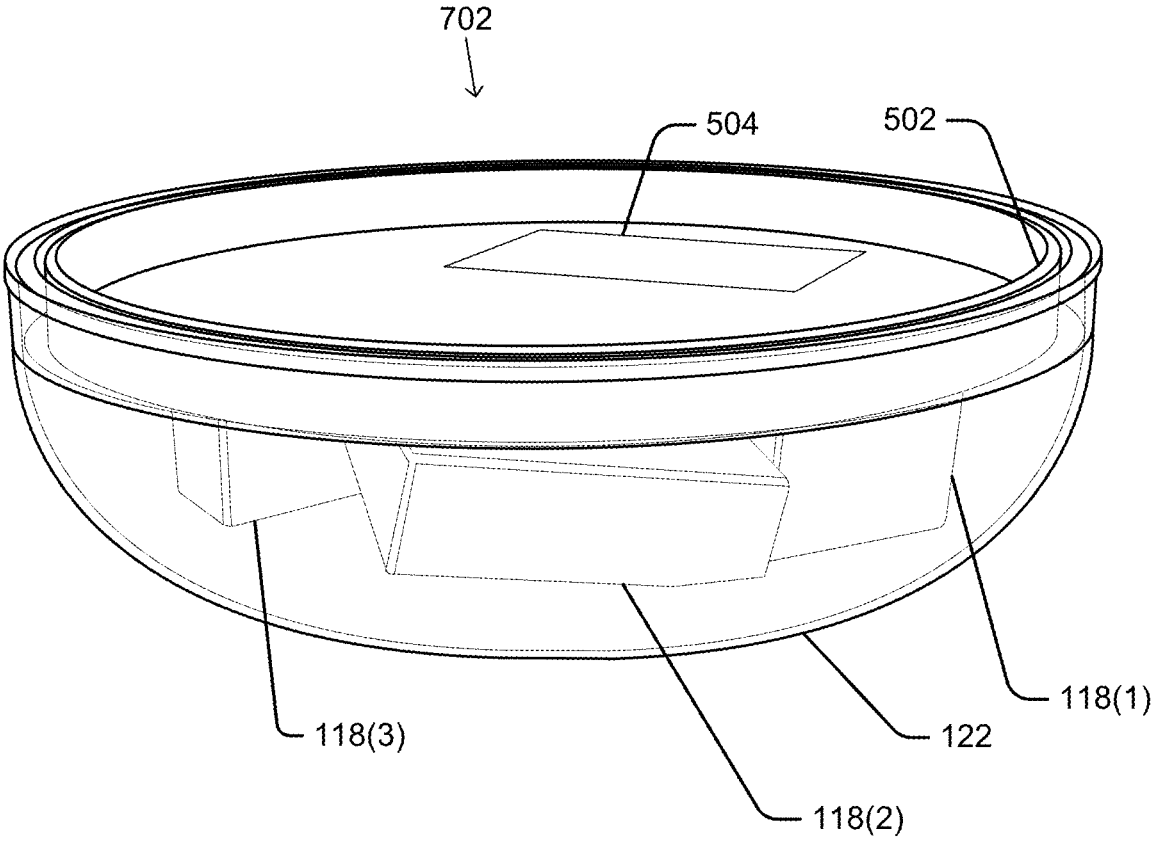
FIG. 7 illustrates an example sealed package with one or more items, according to an embodiment of the present disclosure.

FIG. 7 illustrates an example sealed package 702 with one or more items 118, according to an embodiment of the present disclosure. All portions of the outer side surface of the cover 502 of the sealed package 702 may be sealed to all portions of the inner side surface of the portion of elastic film 122 (e.g., the initial adhering portion of elastic film and the remaining adhering portion of elastic film). All portions of the outer side surface of the cover 502 of the sealed package 702 may be sealed to all portions of the inner side surface of the portion of elastic film 122 by an adhering mechanism. For example, the adhering mechanism may include, but is not limited to, an adhesive glue, a bond between the cover and the elastic film formed by applying heat to melt the cover and the elastic film together, etc.

The sealed package 702 that includes the one or more items 118 and that is sealed can be sent to a recipient of the one or more items 118. In some examples, packaging the one or more items into the sealed package 702, a label can be adhered to the cover 502. In other examples, the portion of elastic film 122 may include a delivery address and other pertinent shipping and/or delivery information, etc. Packaging the one or more items 118 into the sealed package 702 is advantageous compared to merely placing the one or more items 118 in a box or envelope because the sealed package 702 prevents any of the one or more items 118 from being left out and/or lost during shipment, prevents damage to any of the one or more items 118 based on movement or shifting of a package or any of the one or more items 118 during delivery, prevents damage to any of the one or more items 118 due to moisture or other environmental influences, and allows the items 118 to be packaged more efficiently in a smaller container. Regarding the latter, placing the items 118 in a box may result in empty space within the box or the inclusion of dunnage to prevent the items 118 from moving around within the box during delivery. The package described herein may allow the items 118 to be packaged tightly together and may allow the package to have a decreased volume and a streamlined shape.

The sealed package 702 may include items 118 intended for a particular destination, such as a delivery address of a customer that placed an order for the items 118. The sealed package 702 can also be used to transport large quantities of items to a sorting center or other warehouse where items are assembled for delivery. For a customer delivery, the package may be relatively small and just large enough to include and enclose the items 118 to be delivered. For transporting large quantities of items 118, the container 304 used to seal and package the items 118 may be much larger and be made of stronger materials (e.g., metal) and the elastic film used to encapsulate the items 118 may be more robust (e.g., thicker, increased durability, increased elasticity, etc.).

Figure 8:
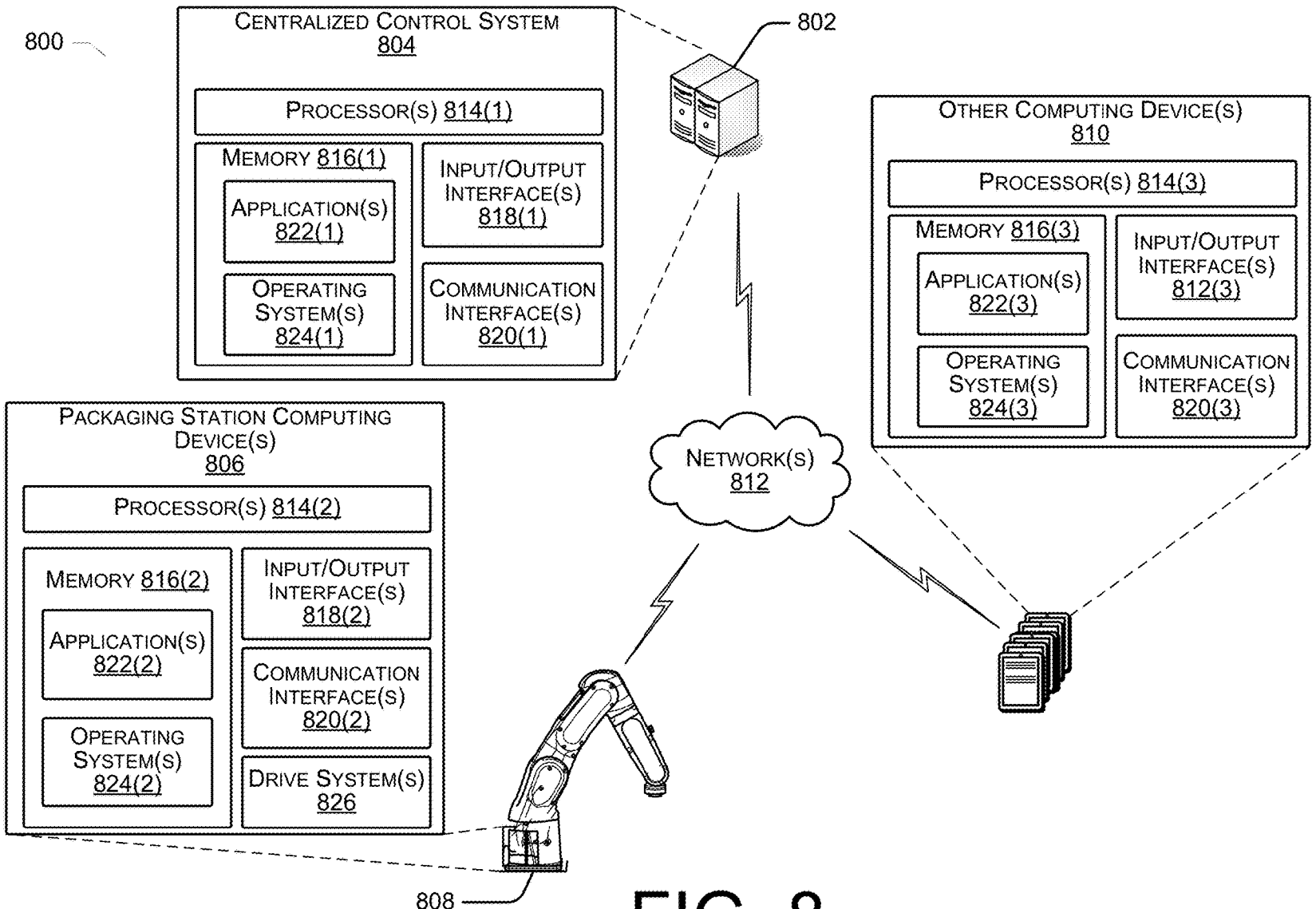
FIG. 8 illustrates an example environment in which one or more computing devices may be utilized in a workspace, according to an embodiment of the present disclosure.

FIG. 8 illustrates an example environment in which one or more computing devices may be utilized in a workspace 800. The computing device(s) may include one or more centralized control system devices 802 of a centralized control system 804 (e.g., centralized controller), one or more packaging station computing device(s) 806 associated with one or more induct mechanism(s) (robotic mechanism(s)) 808, and one or more other computing device(s) 810. The other computing device(s) 810 may include computing devices computing devices utilized by an operator and/or computing devices utilized at various stations in the packaging facility, such as an induction computing device, a consolidation computing device, a ground cargo operator computing device, an air cargo operator computing device, a drive unit computing device, a vehicle operator computing device, and one or more other package and/or container processing computing devices.

The robotic mechanism(s) 808 may include any suitable types of robotic mechanisms, e.g., mobile, semi-mobile, semi-stationary, or stationary. The robotic mechanism(s) 808 may belong to a variety of categories or classes of mechanisms such as robotic devices, robotic arms, robotic actuators, pneumatic arms, pneumatic actuators, etc. Thus, robotic mechanism(s) 808 may include a diverse variety of mechanism types and are not limited to a particular type of mechanism and/or device. For example, the robotic mechanism(s) 808 may represent, but are not limited to, a robotic mechanism positioned in a packaging station and adjacent to a tote and a package preparation mechanism, a robotic mechanism positioned near the packaging station, a robotic mechanism integrated with and/or positioned within a container of a package preparation mechanism, or other components for inclusion in a robotic mechanism, or any other sort of mechanism coverable of automatic operation or operation that is controlled by any of an operator of a packaging station, the centralized control system 804, the packaging station computing device 806, and/or the other computing device(s) 810, and performing the functions according to the techniques described herein.

The centralized control system 804, the packaging station computing device 806, and the other computing device(s) 810 may include any suitable types of computing devices, e.g., mobile, semi-mobile, semi-stationary, or stationary. The centralized control system 804, the packaging station computing device 806, and the other computing device(s) 810 may belong to a variety of categories or classes of devices such as traditional server-type devices, desktop computer-type devices, mobile devices, special purpose-type devices, embedded-type devices, and/or wearable-type devices. Thus, centralized control system 804, packaging station computing device 806, and other computing device(s) 810 may include a diverse variety of device types and are not limited to a particular type of device. For example, the centralized control system 804, the packaging station computing device 806, and the other computing device(s) 810 may represent, but are not limited to, desktop computers, server computers or blade servers such as web-servers, map-reduce servers, or other computation engines or network-attached storage units, personal computers, mobile computers, laptop computers, tablet computers, telecommunication devices, network enabled televisions, thin clients, terminals, personal data assistants (PDAs), game consoles, gaming devices, work stations, media players, personal video recorders (PVRs), set-top boxes, cameras, integrated components for inclusion in a computing device, appliances, or any other sort of computing device coverable of sending communications and performing the functions according to the techniques described herein.

The centralized control system 804, the packaging station computing device 806, and the other computing device(s) 810 may be configured to communicate with one another via a network 812, such as to assist in monitoring packaging of items throughout the packaging facility. The network 812 may include the Internet, cable networks, cellular networks, wireless networks (e.g., Wi-Fi) and/or wired networks, as well as close-range communications such as Bluetooth®, Bluetooth® low energy, or the like.

In the illustrated example, the centralized control system 804, the packaging station computing device 806, and the other computing device(s) 810 include one or more processors 814(1), 814(2), and/or 814(3) (collectively processor(s) 814), at least one memory 816(1), 816(2), and/or 816(3) (collectively memory 816), one or more input/output (I/O) interfaces 818(1), 818(2), and/or 818(3) (collectively I/O interface(s) 818), one or more communication (e.g., network) interfaces 820(1), 820(2), and/or 820(3) (collectively network interface(s) 820). Each processor 814 may include multiple processors and/or a processor having multiple cores. Further, the processor(s) 814 may comprise one or more cores of different types. For example, the processor(s) 814 may include application processor units, graphic processing units, and so forth. In various examples, the processor(s) 814 may include one or more microprocessors, microcomputers, microcontrollers, digital signal processors, central processing units, state machines, logic circuitries, and/or any devices that manipulate signals based on operational instructions. In some examples, the processor(s) 814 may include one or more hardware processors and/or logic circuits of any suitable type specifically programmed or configured to execute the algorithms and processes described herein. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 1002 may possess its own local memory, which also may store program components, program data, and/or one or more operating systems.

In some examples, the processor(s) 814 may be configured to fetch and execute computer-readable processor-executable instructions stored in the memory 816. Depending on the configuration of the centralized control system 804, the packaging station computing device 806, and the other computing device(s) 810, the memory 816 may be an example of tangible non-transitory computer storage media and may include volatile and nonvolatile memory and/or removable and non-removable media implemented in any type of technology for storage of information such as computer-readable processor-executable instructions, data structures, program modules or other data. Such memory 816 may include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory 816 may be implemented as computer-readable storage media ("CRSM"), which may be any available physical media accessible by the processor(s) 814 to execute instructions stored on the memory 816. In some examples, CRSM may include random access memory ("RAM") and Flash memory. In other examples, CRSM may include, but is not limited to, read-only memory ("ROM"), electrically erasable programmable read-only memory ("EEPROM"), or any other tangible medium which can be used to store the desired information, and which can be accessed by the processor(s) 814.

The memory 816 may be used to store and maintain any number of functional components that are executable by the processor 814. In some examples, these functional components comprise instructions or programs that are executable by the processor 814 and that, when executed, implement operational logic for performing the actions and services attributed above to the centralized control system 804, the packaging station computing device 806, and the other computing device(s) 810. Functional components of the centralized control system 804, the packaging station computing device 806, and the other computing device(s) 810 stored in the memory 816(1), 816(2), and/or 816(3) may include applications 822(1), 822(2), and/or 822(3) (collectively applications 822). The applications 822 may configure the respective devices to perform functions described herein such as with regard to FIGS. 1-7, 9, and 10.

The functional components of the centralized control system 804, the packaging station computing device 806, and the other computing device(s) 810 stored in the memory 816(1), 816(2), and/or 816(3) may additionally include operating systems 824(1), 824(2), and/or 824(3), respectively (collectively operating systems 824). The operating system(s) 824 for controlling and managing various functions of the centralized control system 804, the packaging station computing device 806, and the other computing device(s) 810. The memory 816 may also store other modules and data, which may include programs, drivers, etc., and the data used or generated by the functional components, to enable efficient and effective food order processing. Further, the centralized control system 804, the packaging station computing device 806, and the other computing device(s) 810 may include many other logical, programmatic and physical components, of which those described are merely examples that are related to the discussion herein. In addition, the memory 816 may also store data, data structures and the like, that are used by the functional components.

The I/O interface(s) 818, may include scanners (e.g., for scanning bar codes, QR codes, etc.), speakers, a microphone, a camera, and various user controls (e.g., buttons, a joystick, a keyboard, a keypad, etc.), a haptic output device, and so forth. The communication interface(s) 820 may include one or more interfaces and hardware components for enabling communication with various other devices over the network or directly.

In various examples, the packaging station computing device may additionally include one or more drive systems 826. The drive system(s) 826 may enable the robotic arm 808 to operate to package items delivered to the packaging station. The drive system(s) may control various movements of the robotic arm(s) 808. In various examples, the drive system(s) 826 may receive data from one or more sensors and/or data embedded in, etched into, painted on, or otherwise displayed on an and/or proximate to an operating surface of the drive unit 808.

Figure 9:
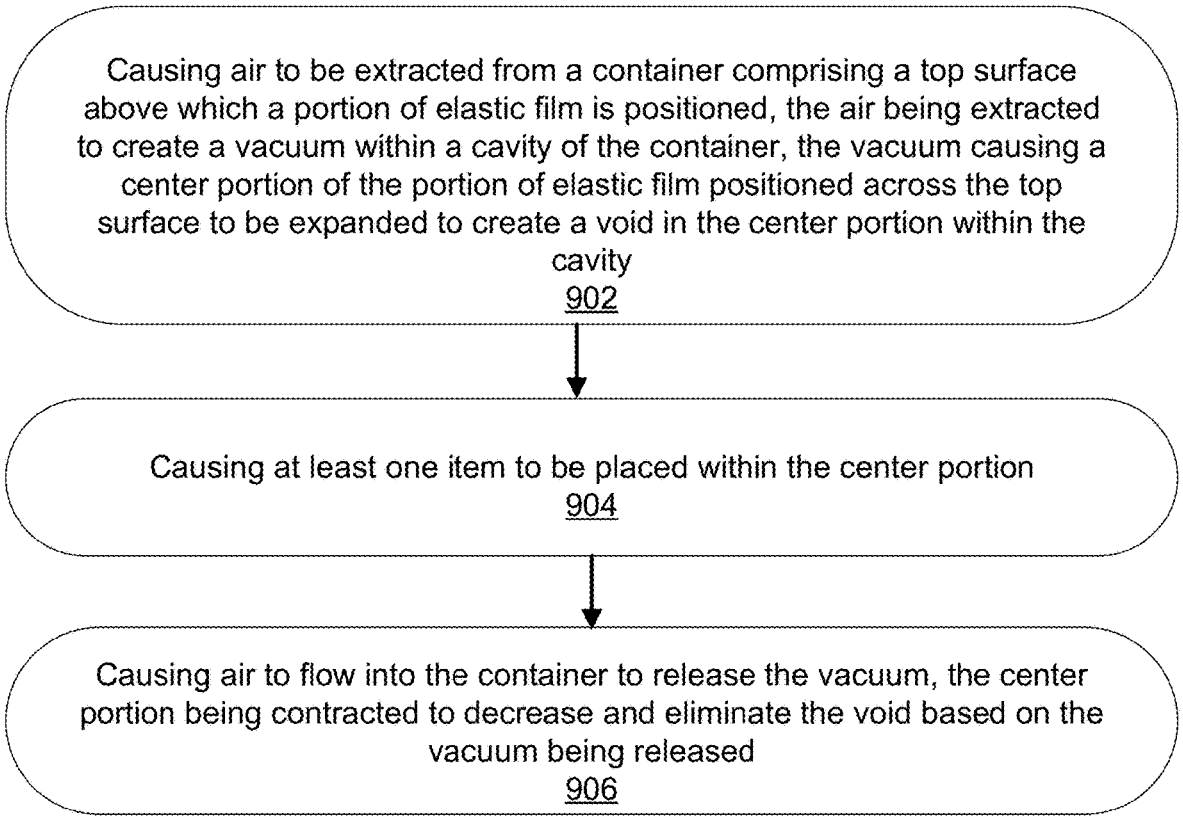
FIG. 9 illustrates a flow diagram of an example process for packaging items into packages and sealing the packages, according to an embodiment of the present disclosure.

FIG. 9 illustrates a flow diagram of an example process 900 for packaging one or more items 118 into packages and sealing the packages, according to an embodiment of the present disclosure. Some or all of the steps of the process 900 may be performed by various components in a system, the components including one or more of the centralized control system 804, the packaging station computing device 806, and the other computing device(s) 810 operated by personnel within the workspace 800 of FIG. 8.

At block 902, the process includes causing air to be extracted from a container 304 comprising a top surface above which a portion of elastic film 122 is positioned. The air is extracted by opening a valve 302 to create a vacuum within a cavity 306 of the container 304. The vacuum may cause a center portion of the portion of elastic film 122 positioned across the top surface to be expanded and extended downward into the cavity 306 of the container 304 to create a void in the center portion within the cavity 306. A robotic arm 102 may move and position a clamp 202 above a surface of the portion of elastic film 122 (e.g., top surface of the portion of elastic film 122). The clamp 202 may be utilized to restrain and/or prevent movement of the portion of elastic film 122 such that the elastic film 122 does not move or slip while items are being placed within the container 304, and to allow the vacuum to be created in the cavity 306. The clamp 202 may apply pressure to the portion of elastic film 122 to create an air tight seal between the portion of elastic film 122 and the top surface of the container 304.

At block 904, the process includes causing at least one item (e.g., at least one of one or more items 118) to be placed within the center portion. The at least one of the one or more items 118 may be moved by a robotic arm 102, from a tote 104, and into the void created by the vacuum causing the elastic film 122 to extend downwards into the cavity 306 of the container 304. The at least one of the one or more items 118 may be received in the tote 104 in a sorted order or an unsorted order.

At block 906, the process includes causing air to flow into the container 304 to release the vacuum, the center portion being contracted to decrease and eliminate the void based on the vacuum being released. After the cover 304 is placed on the top surface of the container 304, the air is caused to flow into the container 304 by opening a valve 302 coupled to a lower surface of the container 304. The center portion, for a cover sealing mode, may be partially sealed to a cover 304 prior to the air being allowed to flow into the container 304. The cover 304 subsequently may be completely sealed to the center portion, based on the air having been allowed to flow into the container 304, and further based on the vacuum having been released. The center portion, for a twist tie sealing mode, may be partially sealed by partially rotating the center portion, prior to the air being allowed to flow into the container 304. The center portion subsequently may be completely sealed by completely rotating the center portion, based on the air having been allowed to flow into the container 304, and further based on the vacuum having been released.

While various examples and embodiments are described individually herein, the examples and embodiments may be combined, rearranged and modified to arrive at other variations within the scope of this disclosure.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A system comprising:

a container;

an induct mechanism that is configured to pick a plurality of items from a first location and place the items into the container at a second location different from the first location;

the container having a cylindrical shape and comprising:

at least one side surface;

a bottom surface; and a top surface comprising an opening;

an elastic film that includes a first portion that is extended across the top surface;

a clamp positionable to exert a downward force onto the first portion of the elastic film, the clamp causing the first portion of the elastic film to be affixed to the top surface;

a valve, located at the bottom surface, to allow air to be removed from a cavity within the container to create a vacuum within the cavity, the elastic film comprising a center portion that expands and extends downward into the cavity as a result of the vacuum being created, causing a void between the center portion of the elastic film and the opening;

a sensor in the cavity configured to generate a sensor signal indicating a position of the center portion of the elastic film relative to the valve;

a cover placed in the opening, the cover having a side surface with a second portion that is adhered to the elastic film, the side surface having a remaining portion not adhered to the elastic film to allow air to flow out of the void as the valve allows air to flow into the cavity and the vacuum is released;

a computing device configured to:

store identification information or a plurality of characteristics associated with the plurality of items, determine an order based on the identification information or the plurality of characteristics associated with the plurality of items, cause the induct mechanism to sequentially place the items into the void based on the order, cause operation of the valve based on the sensor signal, determine that the cover is positioned on the container, and cause the valve to open to release the vacuum and decrease a size of the void and thereby cause the center portion of the elastic film to contract towards the items based on the determination that the cover is positioned on the container.

2. The system of claim 1, wherein the cover is placed within the opening to partially seal the opening at a first time as the vacuum is released and to completely seal the opening at a second time that is subsequent to the first time.

3. The system of claim 1, further comprising:

a spool positioned adjacent to the container to dispense the first portion of the elastic film that is extended across the top surface.

4. The system of claim 1, wherein:

the clamp applies pressure in a downward direction to prevent movement of the first portion of the elastic film across the top surface as the center portion expands and extends downward into the cavity as a result of the vacuum being created; and the remaining portion of the side surface is adhered to the center portion of the elastic film after the vacuum is released to completely seal the items between the cover and the center portion of the elastic film.

5. The system of claim 1, wherein the induct mechanism is a robotic arm, and the second location is in the void, the system further comprising:

a tote adjacent to the robotic arm, the tote including the first location.

6. The system of claim 1, wherein the clamp applies pressure in a downward direction to prevent movement of the first portion of the elastic film across the top surface as the center portion expands and extends downward into the cavity as a result of the vacuum being created.

7. A system comprising:

a container that includes a bottom surface and an opening opposite the bottom surface;

an induct mechanism;

an elastic film positioned in a substantially planar orientation over the opening of the container;

a valve located at the bottom surface of the container to cause air to be extracted from a cavity within the container to create a vacuum within the cavity, the elastic film including a first portion that expands and extends downward into the cavity to create a void, as a result of the vacuum, between the opening and the first portion of the elastic film, the valve further configured to allow air to flow into the cavity to release the vacuum based at least in part on a plurality of items being placed into the void;

a sensor in the cavity configured to generate a sensor signal indicating a distance between the first portion of the elastic film and the valve; and a computing device configured to:

store identification information or a plurality of characteristics associated with the plurality of items, determine an order based at least in part on the identification information or the plurality of characteristics associated with the plurality of items, cause the induct mechanism to sequentially place the plurality of items into the void based at least in part on the order, control operation of the valve based at least in part on the sensor signal, determine that the first portion of the film including the void and the plurality of items is partially sealed, and cause the valve to open to release the vacuum thereby causing the first portion of the elastic film to contract towards the items based at least in part on the determination that the first portion is partially sealed.

8. The system of claim 7, wherein at least a portion of the void is reduced in size as the air flows into the cavity to release the vacuum.

9. The system of claim 8, wherein, after the air flows into the cavity to release the vacuum, a size of the at least the portion of the void created in the first portion of the elastic film is substantially equal to a total size of the plurality of items.

10. The system of claim 7, further comprising:

a spool positioned adjacent to the container to dispense the elastic film positioned over the opening of the container.

11. The system of claim 7, wherein:

the elastic film includes a second portion at a top surface of the container;

the elastic film includes a third portion that is between the first portion and the second portion, and that is twisted based at least in part on the first portion being rotated; and a clasp is placed around the third portion to seal the first portion.

12. The system of claim 7, further comprising:

a cover that is placed within the opening of the container and that has a side surface with a second portion adhered to the elastic film to partially seal the cover to the elastic film as the vacuum is released, wherein a remaining portion of the side surface of the cover is adhered to the elastic film to completely seal the cover to the elastic film, based at least in part on the vacuum having been released.

13. The system of claim 7, further comprising:

a clamp that is positioned on a second portion of the elastic film that is located on a perimeter of the opening of the container, the clamp applying a force in a downward direction to restrict movement of the second portion of the elastic film as the air is extracted from the cavity, wherein the clamp is removed from the second portion of the elastic film based at least in part on the vacuum being released from the cavity.

14. The system of claim 7, wherein a first amount of potential movement of the plurality of items that is restricted by the first portion of the elastic film after the vacuum is released is less than a second amount of potential movement of the plurality of items that is restricted by the first portion of the elastic film before the vacuum is released.

15. The system of claim 7, further comprising:

a robotic arm to transport the plurality of items; and a tote adjacent to the robotic arm, wherein the robotic arm is controlled to pick the plurality of items from the tote and place the plurality of items into the void based at least in part on the first portion of the elastic film having been expanded and extended downward into the cavity.

16. A system comprising:

a container that includes a bottom surface and an opening opposite the bottom surface;

an induct mechanism;

an elastic film;

a valve located at the bottom surface of the container to cause air to be extracted from a cavity within the container to expand the elastic film positioned over the opening, the elastic film extending downward into the cavity to create a void between the opening and the elastic film as a result of the air being extracted, the valve further configured to allow air to flow into the cavity based at least in part on at least one item of a plurality of items being placed into the void;

a sensor in the cavity configured to generate a sensor signal indicating a distance between the elastic film and the valve has decreased to less than or equal to a threshold distance; and a computing device configured to:

store identification information or a plurality of characteristics associated with the plurality of items, determine an order based at least in part on the identification information or the plurality of characteristics associated with the plurality of items, cause the induct mechanism to sequentially place the plurality of items into the void based at least in part on the order, and close the valve based at least in part on the sensor signal, and cause the valve to open to decrease a size of the void thereby causing the elastic film to contract towards the items.

17. The system of claim 16, wherein the air is extracted from the cavity to create a vacuum within the cavity, and, based at least in part on the plurality of items being placed into the void, the air is allowed to flow into the cavity to release the vacuum.

18. The system of claim 16, wherein, after the air flows into the cavity, a size of at least a portion of the void is substantially equal to a total size of the plurality of items.

19. The system of claim 16, further comprising:

a spool positioned adjacent to the container to dispense the elastic film positioned over the opening of the container.

* * * * *